US009075384B2

(12) United States Patent
Shimonaga

(10) Patent No.: US 9,075,384 B2
(45) Date of Patent: Jul. 7, 2015

(54) STORAGE DEVICE AND IMAGE FORMING APPARATUS

(71) Applicant: FUJI XEROX CO., LTD., Minato-ku, Tokyo (JP)

(72) Inventor: Akio Shimonaga, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 145 days.

(21) Appl. No.: 13/862,808

(22) Filed: Apr. 15, 2013

(65) Prior Publication Data

US 2014/0112682 A1 Apr. 24, 2014

(30) Foreign Application Priority Data

Oct. 19, 2012 (JP) ..... 2012-231782

(51) Int. Cl.
*G03G 21/16* (2006.01)
*G03G 15/08* (2006.01)

(52) U.S. Cl.
CPC .... *G03G 21/1633* (2013.01); *G03G 2221/1684* (2013.01); *G03G 15/0879* (2013.01)

(58) Field of Classification Search
CPC ..... G03G 21/1633; G03G 2221/169; G03G 15/0879; G03G 15/0872; G03G 15/0836; G03G 2221/1684; G03G 2221/163
USPC ..... 399/107, 120, 119, 262; 361/679.58, 361/726, 732, 747; 312/222, 270.3, 332.1, 312/333; 70/78, 79
See application file for complete search history.

(56) References Cited

U.S. PATENT DOCUMENTS 8,315,536 B2 * 11/2012 Fujita ..... 399/110
8,610,964 B2 * 12/2013 Watanabe ..... 358/471
8,699,913 B2 * 4/2014 Lee et al. ..... 399/111
2010/0246109 A1 9/2010 Matsubara

FOREIGN PATENT DOCUMENTS

JP 2010-232296 A 10/2010

* cited by examiner

*Primary Examiner* — Robert Beatty
(74) *Attorney, Agent, or Firm* — Sughrue Mion, PLLC

(57) ABSTRACT

A storage device includes a housing including a storage space that stores a structural member; a cover member that is mounted on the housing, and causes an entrance of the storage space of the housing to be in a covered state and an uncovered state; and a fixing mechanism that fixes the cover member to the housing that is in the covered state. The structural member is stored at a first position and at a second position in an unfixed state in the storage space that is caused to be in the covered state by the cover member. The second position is closer to the cover member than the first position is. When the structural member has moved from the first position to the second position, the fixing mechanism causes the cover member to be more firmly fixed than when the structural member is stopped at the first position.

8 Claims, 26 Drawing Sheets

STORAGE DEVICE AND IMAGE FORMING APPARATUS

CROSS-REFERENCE TO RELATED APPLICATIONS

This application is based on and claims priority under 35 USC 119 from Japanese Patent Application No. 2012-231782 filed Oct. 19, 2012.

BACKGROUND

Technical Field

The present invention relates to a storage device and an image forming apparatus.

SUMMARY

According to an aspect of the invention, there is provided a storage device including a housing including a storage space that stores a structural member; a cover member that is mounted on the housing, and causes an entrance of the storage space of the housing to be in a covered state and an uncovered state; and a fixing mechanism that fixes the cover member to the housing that is in the covered state. The structural member is stored at a first position and at a second position in an unfixed state in the storage space that is caused to be in the covered state by the cover member. The second position is closer to the cover member than the first position is. When the structural member has moved from the first position to the second position, the fixing mechanism causes the cover member to be more firmly fixed than when the structural member is stopped at the first position.

BRIEF DESCRIPTION OF THE DRAWINGS

Exemplary embodiments of the present invention will be described in detail based on the following figures, wherein.

DETAILED DESCRIPTION

Exemplary embodiments of the present invention will hereunder be described with reference to the drawings.

Prior to describing the exemplary embodiments, some of the terms, etc., used to, for example, address the problems will be described. The term "cover member" refers to everything that functions to cover a mouth or opening portion of a housing, such as a container or a box. The phrase "stored in an unfixed state" refers to a state in which a structural member is unfixed in a storage space of the housing, and is, thus, freely movable. More specifically, an example thereof is when a structural member is stored so as to be freely movable in a storage space when, for example, receiving shock from outside the housing or the housing itself is tilted. The phrase "causes the cover member to be more firmly fixed" refers to increasing fixing force when the cover member is fixed to the housing. An increase in the fixing force may be converted using, for example, strength with respect to external shock. The phrase "momentum is converted . . . " refers to a state in which momentum of a structural element that is moving is used in the movement of a different target object. This also corresponds to, for example, a phenomenon that occurs when, for example, objects collide with each other.

First Exemplary Embodiment

Figure 1:
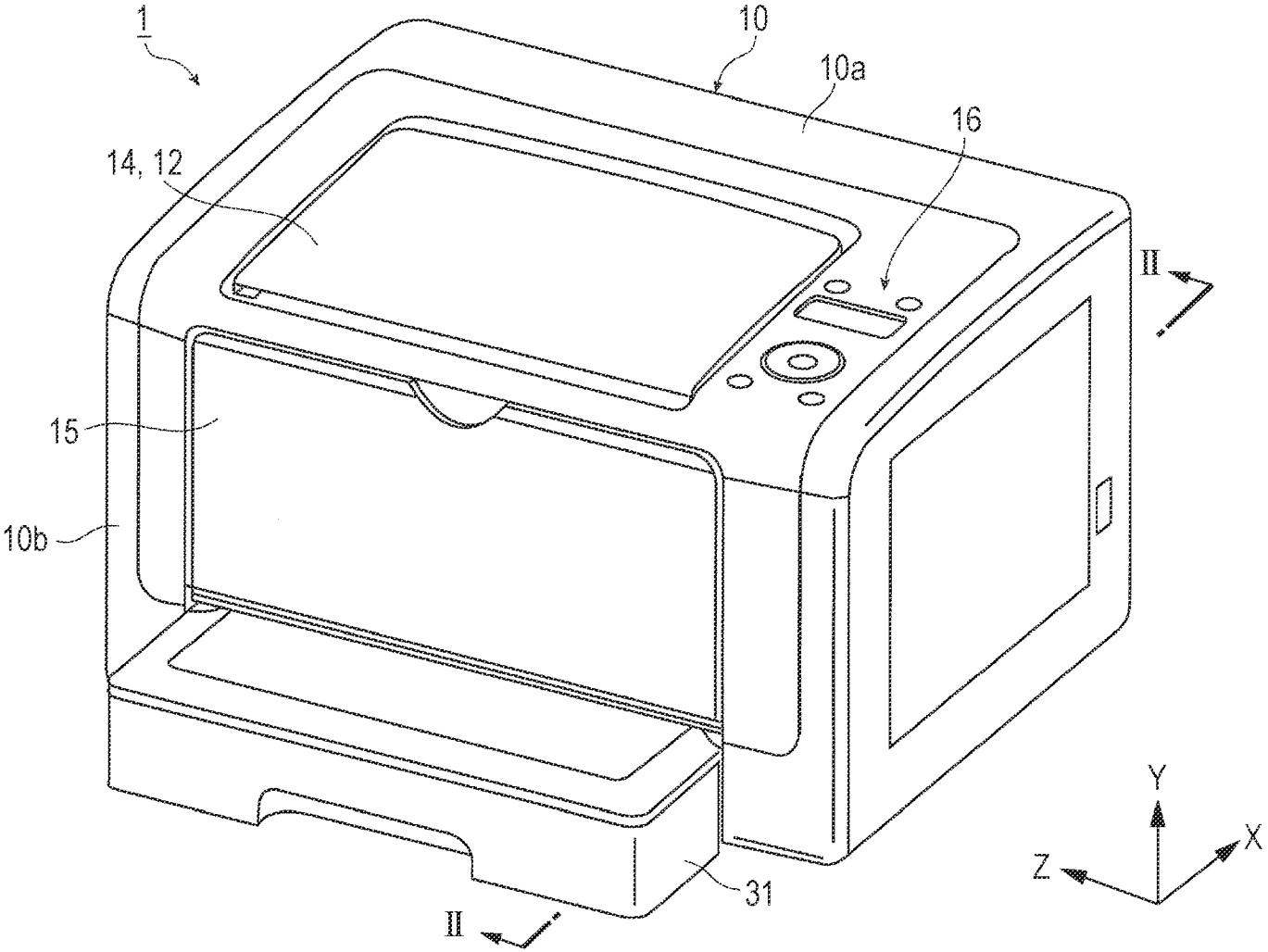
FIG. 1 is a external perspective view of an image forming apparatus including a storage device according to, for example, a first exemplary embodiment.
Figure 2:
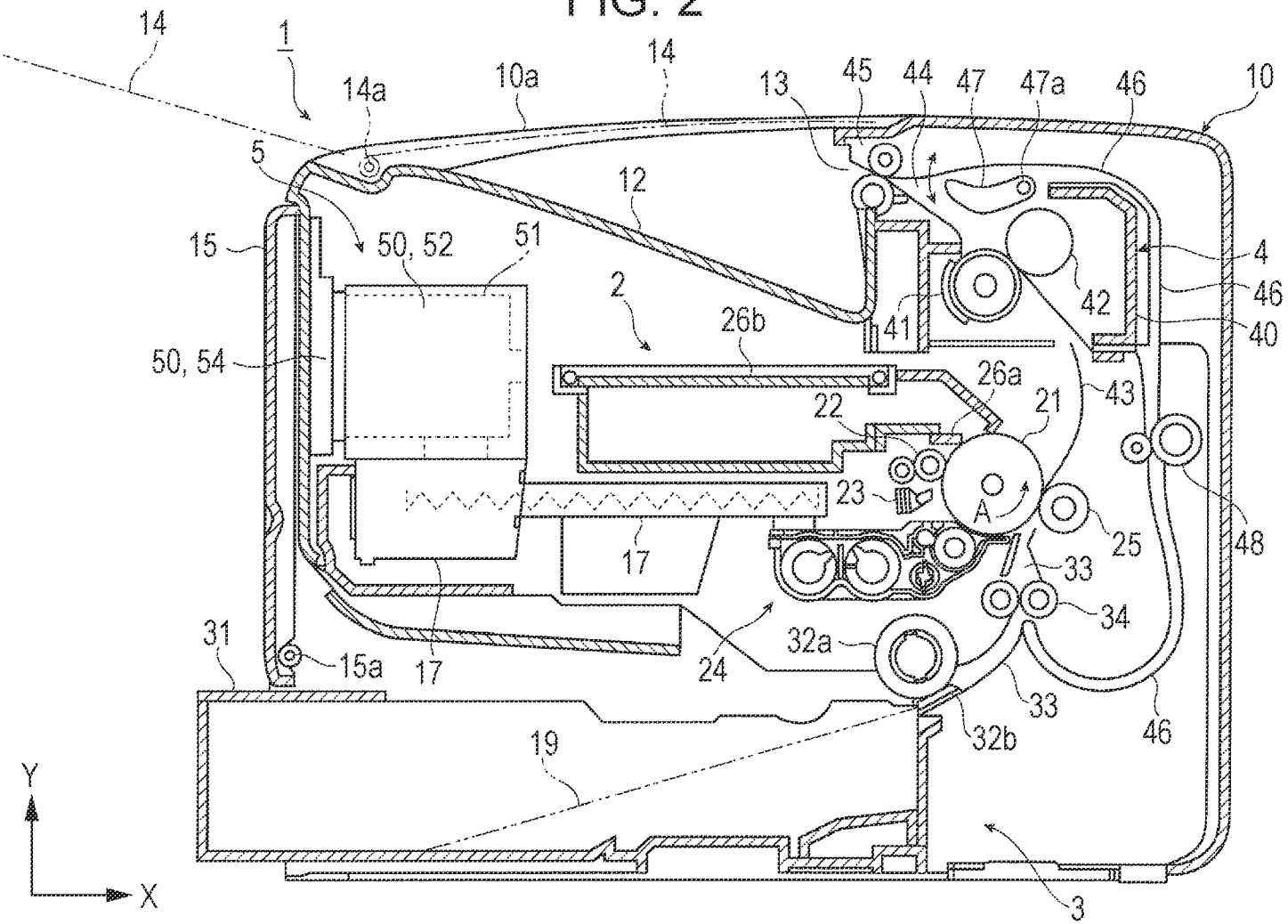
FIG. 2 is a schematic sectional view taken along line II-II of the image forming apparatus shown in FIG. 1.
Figure 3:
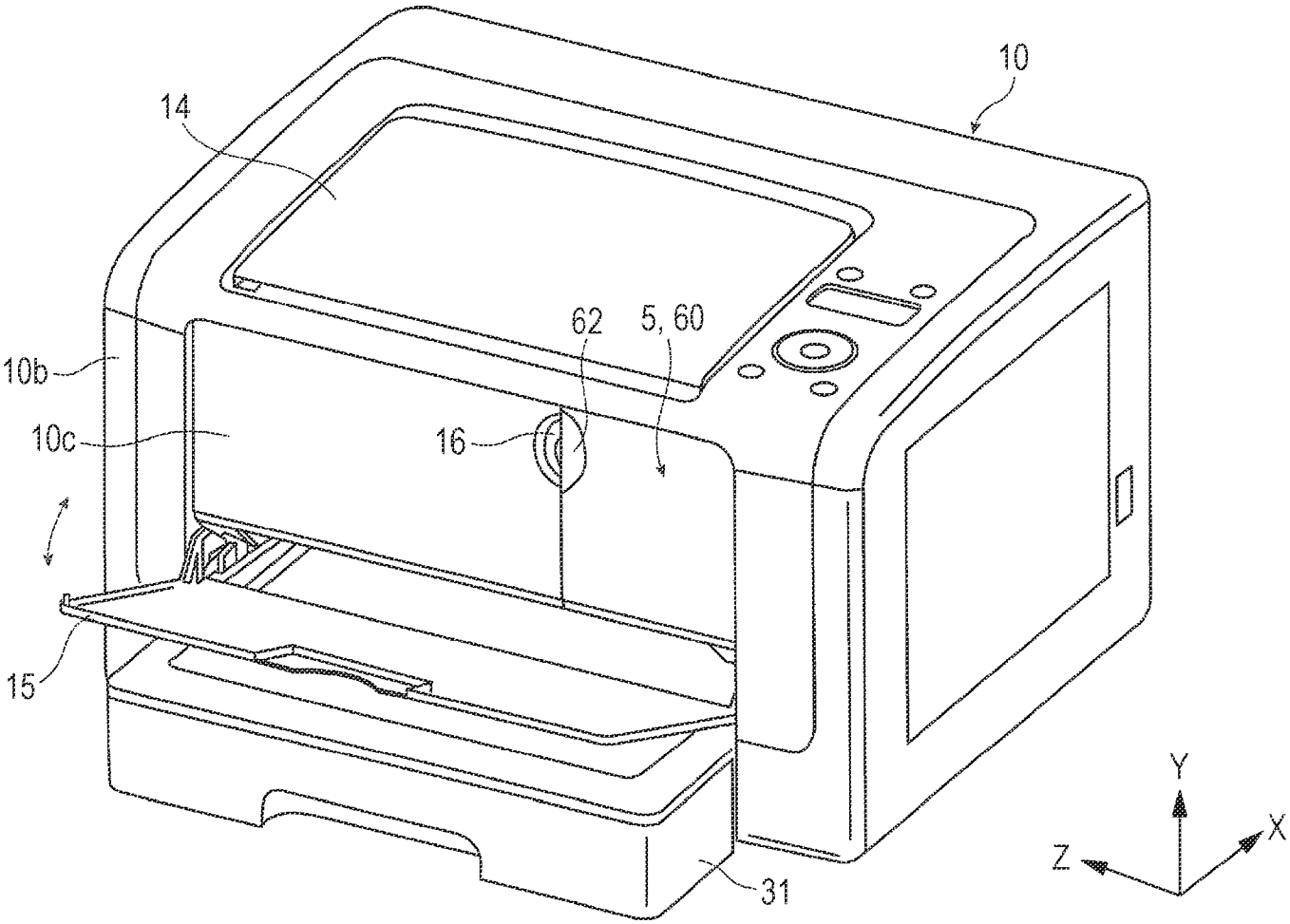
FIG. 3 is a perspective view showing a state in which a front cover in the image forming apparatus shown in FIG. 1 is open.
Figure 4:
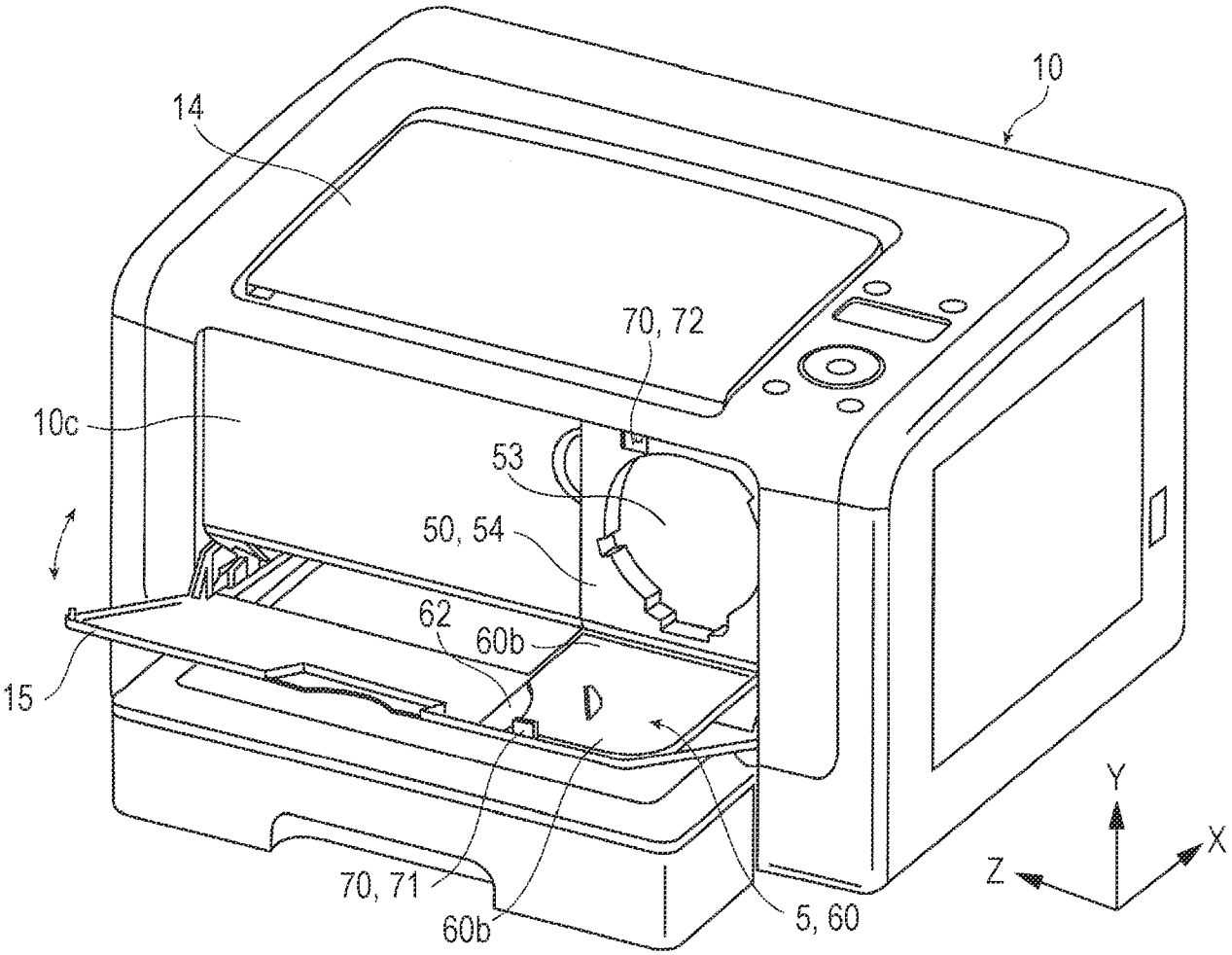
FIG. 4 is a perspective view showing a state in which an opening/closing cover of the storage device in the image forming apparatus shown in FIG. 3 is open.
Figure 5:
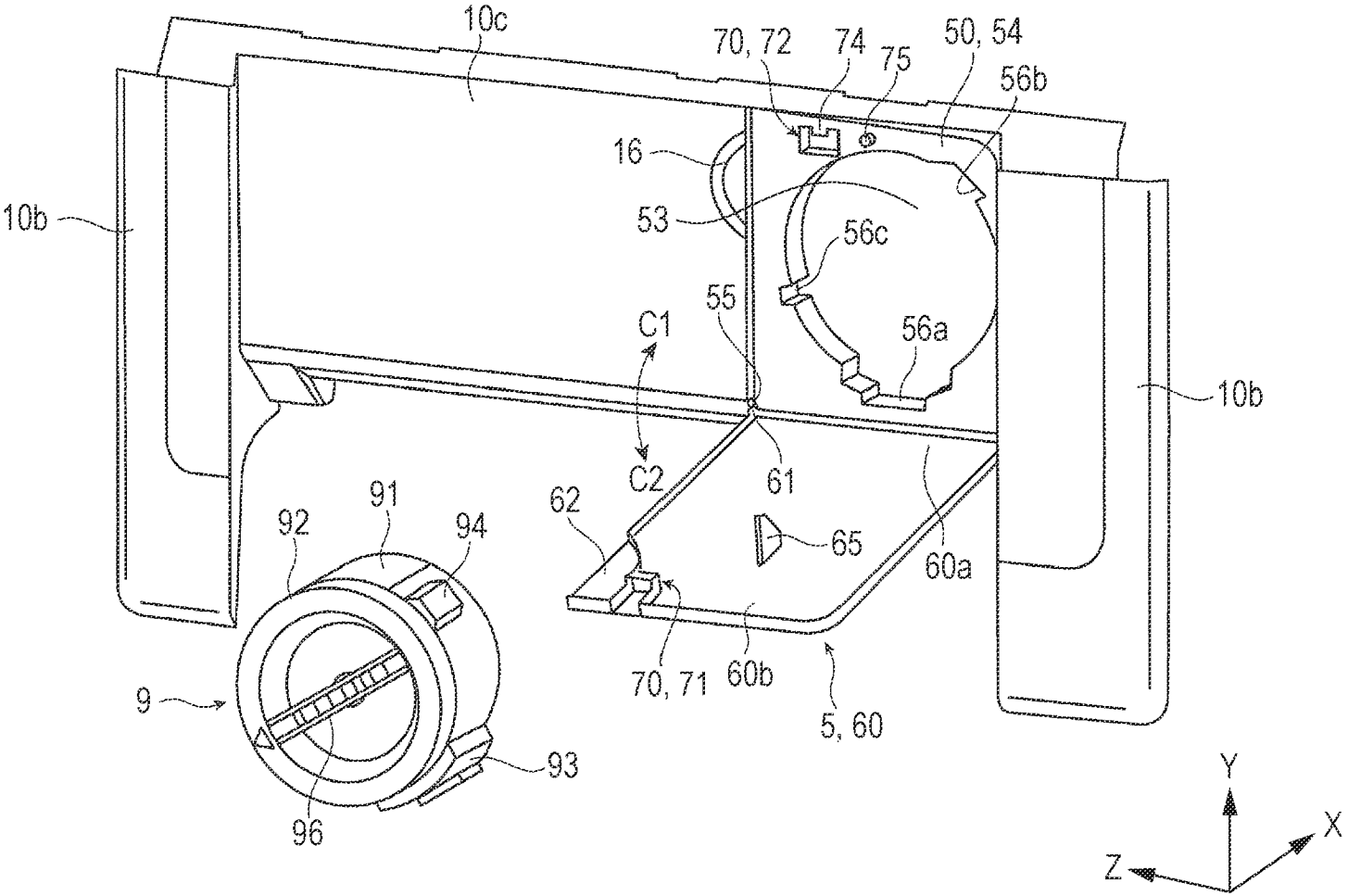
FIG. 5 is a perspective view of a portion of the storage device and a developing storage container that is stored.

FIGS. 1 to 5 each show an image forming apparatus 1 including a storage device 5 according to a first exemplary embodiment. FIG. 1 is an external view of the image forming apparatus 1. FIG. 2 shows the structure of the interior of the image forming apparatus 1. FIG. 3 is an external view of a case when a front cover 15 of the image forming apparatus 1 shown in FIG. 1 is opened. FIG. 4 is an external view of a case when an entrance cover of the storage device 5 in the image forming apparatus 1 shown in FIG. 3 is opened. FIG. 5 shows an entrance (frame) of a storage space in the storage device 5 and a cartridge-type developer container that is stored in the storage device 5.

Overall Structure of Image Forming Apparatus

The image forming apparatus 1 includes a housing 10 formed of, for example, a supporting structural member or an external member. As shown in, for example, FIGS. 1 and 2, the housing 10 has an overall appearance of a box, and has a required space in the interior thereof. A top surface 10*a* of the housing 10 is provided with a discharge holding section 12 that holds recording paper 19 that is discharged after formation of an image. The discharge holding section 12 is formed as, for example, an inclined surface. A sheet discharge opening 13 is formed in a portion of the housing 10 near the discharge holding section 12. The recording paper 19 on which the image is formed is discharged towards the discharge holding section 12. In the first exemplary embodiment, a dustproof protective cover 14 is provided on the top surface 10*a* of the housing 10. The dustproof protective cover 14 (also serving as an extended discharge tray) rotates around a support shaft 14*a*, serving as a fulcrum, to cause the discharge holding section 12 and the sheet discharge opening 13 to be in an uncovered state or a covered state. Further, the front cover 15 is provided on a front surface 10*b* of the housing 10. The front cover 15 rotates around a support shaft 15*a*, serving as a fulcrum, and also serves as a manual paper tray that is opened and closed. Reference numeral 16 in, for example, FIG. 1 denotes an operating section disposed on the top surface 10*a* of the housing. The operating section 16 includes, for example, buttons (for performing input, etc.), a lamp, and a display panel that displays information concerning, for example, setting content.

The image forming apparatus 1 is formed as a printer. The image forming apparatus 1, serving as a printer, includes, for example, an image forming unit 2, a sheet-feeding device 3, and a fixing device 4 in a space in the housing 10. The image forming unit 2 forms a toner image, formed of toner (serving as developer), and transfers the toner image to recording paper 19 (serving as an exemplary recording material). The sheet feeding device 3 holds and transports pieces of recording paper 19, which are supplied to the image forming unit 2. The fixing device 4 fixes the toner image, formed by the image forming unit 2, to the recording paper 19.

The image forming unit 2 is formed using, for example, a publicly known electrophotographic system. The image forming unit 2 primarily includes a photoconductor drum 21, a charging device 22, an exposure device 23, a developing device 24, a transfer device 25, and a cleaning device 26. The photoconductor drum 21 is rotationally driven in the direction of arrow A (that is, counterclockwise in FIG. 2). The charging device 22 charges to a required potential an outer peripheral surface of the photoconductor drum 21 corresponding to an image formation area. The exposure device 23 forms an electrostatic latent image having a potential difference on the charged outer peripheral surface of the photoconductor drum 21 by irradiating the outer peripheral surface with light that is based on required image information (signal). The developing device 24 develops the electrostatic latent image using toner and forms a toner image. The transfer device 25 transfers the toner image from the photoconductor drum 21 to the recording paper 19. The cleaning device 26 cleans the surface of the photoconductor drum 21 after the transfer by removing, for example, residual toner therefrom.

The photoconductor drum 21 is formed by placing required layers, such as photosensitive layers, upon a circular cylindrical or circular columnar conductive base that is not connected to ground. The photoconductor drum 21 rotates by receiving rotational power from a driving device (not shown). The charging device 22 is, for example, a contact type that uses a charging roller that contacts the outer peripheral surface of the photoconductor drum 11 and rotates. A required charging voltage is supplied from a power supply section (not shown) to the charging roller. As the exposure device 23, for example, an LED array including light-emitting diodes or optical components is used. The exposure device 23 operates when image information which is input to the image forming apparatus 1 using a required unit from an external device and which is subjected to, for example, a required image processing operation is transmitted to the exposure device 23.

The developer 24 is one that uses two-component developer including toner and carrier particles. For example, a member that drives the two-component developer so as to stir and transport the two-component developer and a developing roller that transports the two-component developer so that the two-component developer passes a development area that opposes the photoconductor drum 21 are disposed in a container body of the developing device 24 that contains the two-component developer. The transfer device 25 is, for example, a contact type device that uses a transfer roller that contacts the outer peripheral surface of the photoconductor drum 11 and rotates. The transfer device 25 is such that a required transfer voltage is supplied to the transfer roller from a power supply section (not shown). The cleaning device 26 is, for example, one that includes a cleaning plate 26*a* and a container 26*b*. The cleaning plate 26*a* contacts the outer peripheral surface of the photoconductor drum 11 and scrapes off and removes, for example, residual toner. The container 26*b* contains, for example, the removed residual toner.

The sheet feeding device 3 includes a sheet holding member 31 and a sending out device 32. The sheet holding member 31 is, for example, a tray type member or a cassette type member that holds pieces of recording paper that are placed upon each other. The pieces of recording paper are of required sizes, types, etc., that are used when forming an image. The sending out device 32 sends out the pieces of recording paper 19 that are held in the sheet holding member 31 one at a time towards a transport path. When pieces of recording paper are to be fed, the pieces of recording paper 19 are sent out one at a time. For example, the sheet holding member 31 is removably mounted by sliding the sheet holding member 31 with respect to the housing 10, and is formed so that the sheet holding member 31 is capable of being replenished with pieces of recording paper 19. The sending out device 32 includes, for example, a sheet sending-out roller 32*a* and a sheet restraining pad 32*b*.

In the fixing device 4, a heating rotating body 41 and a pressing rotating body 42 are disposed in the housing 10 where an introducing opening and a discharge opening through which recording paper 19 passes are formed. The heating rotating body 41 has, for example, the form of a roller or a belt that is heated by a heating unit so that its surface temperature is increased to a required temperature and maintained thereat. The heating rotating body 41 is rotationally driven in a required direction. The pressing rotating body 42 has, for example, the form of a roller or a belt that is driven and rotated while contacting the heating rotating body 41 with a required pressure substantially along an axial direction of the heating rotating body 41. The fixing device 4 performs a fixing operation (heating and pressing) by causing the recording paper 19 to which a toner image has been transferred to enter and pass a contact section (fixing section) where the heating rotating body 41 and the pressing rotating body 42 contact each other.

In the image forming apparatus 1, a sheet feed path 33 is provided at a portion situated between the sheet feeding device 3 and a transfer position of the image forming unit 2 (which is situated between the photoconductor drum 11 and the transfer device 25) in the housing 10. The sheet feed path 33 is provided for transporting recording paper 19 that is sent out from the sheet feeding device 3 towards the transfer position. The sheet feed path 33 is defined by, for example, a sheet transport guide and a pair of sheet transport rollers 34. The pair of sheet transport rollers 34 in the sheet feed path 33 are formed as rollers that adjust the time when the recording paper 19 is sent to the transfer position of the image forming unit 2.

An intermediate transport path 43 is provided at a portion situated between the fixing device 4 and the transfer position of the image forming unit 2 in the housing 10. The intermediate transport path 43 is provided for transporting the recording paper that is sent from the image forming unit 2 after the transfer towards the fixing device 4. A discharge path 44 is provided at a portion situated between the fixing device 4 and the sheet discharge opening 13 of the housing 10. The discharge path 44 is provided for transporting recording paper 19 that is sent from the fixing device 4 after the fixing towards the discharge opening 13. The discharge path 44 is defined by, for example, a sheet transport guide and a pair of sheet discharge rollers 45.

A reversal re-transport path 46 is provided at a portion situated between the discharge path 44 and the sheet feed path 33 in the housing 10. The reversal re-transport path 46 is provided for re-transporting recording paper 19, to whose one side an image is formed and that is discharged through the discharge path 44, while the front and back of the recording paper 19 is reversed. The reversal re-transport path 46 is defined by, for example, a sheet transport guide, a transport destination switching lug 47, and a pair of sheet transport rollers 48. The transport destination switching lug 47 rotates around a support shaft 47*a* as indicated by a double-headed arrow and guides a back portion of the recording paper 19 that is being discharged from the discharge path 44 while being interposed between the discharge rollers 45 so that the recording paper 19 is sent into the reversal transport path 46 as a result of reverse rotation of the discharge rollers 45.

In the image forming apparatus 1, the developing device 24 in the image forming unit 2 is replenished by a required amount of toner and at a required time using a toner replenishing device 17. The toner is developer that is stored in a developer container 9. The developer container 9 is removably mounted to the storage device 5 that is provided in the housing 10. The storage device 5 will be described in detail below.

Basic Operation of Image Forming Apparatus

Image formation is performed by the image forming apparatus 1 as follows.

When the image forming apparatus 1 receives an image formation operation start instruction, the image forming unit 2 is such that after the outer peripheral surface of the photoconductor drum 21 that starts rotating in the direction of arrow A is charged to a predetermined polarity and potential by the charging device 22, the charged outer peripheral surface of the photoconductor drum 21 is exposed on the basis of image information from an exposure device 23, so that an electrostatic latent image of a required potential is formed. Next, when the electrostatic latent image that has been formed on the photoconductor drum 21 passes the developing device 24, the electrostatic latent image is made visible by being formed into a toner image as a result of the electrostatic latent image being developed by toner that is supplied from the developing device 24 (developing roller) and that is charged to a required polarity.

Next, when the toner image that has been formed on the photoconductor drum 21 is transported to the transfer position opposing the transfer device 25 by the rotation of the photoconductor drum 21, the transfer device 25 electrostatically transfers the toner image to recording paper 19 that is supplied through the transport path 33 from the sheet feeding device 3 in accordance with an image formation timing. After the transfer, the outer peripheral surface of the photoconductor drum 21 is cleaned using a cleaning device 26.

Next, the recording paper 19 to which the toner image has been transferred at the image forming unit 2 is transported so as to be introduced into the fixing device 4 through the intermediate sheet feed path 43 after the recording paper 19 has been separated from the photoconductor drum 21. When the recording paper 19 passes the contact section of the fixing device 4 where the heating rotating body 41 and the pressing rotating body 42 contact each other, the recording paper 19 is heated while being pressed, so that the toner image is fused and fixed to the recording paper 19. After the fixing is completed, if the image formation operation is that for forming an image on one side, the recording paper 19 that has been discharged from the fixing device 4 passes through the discharge path 44, is discharged from the housing 10, finally drops into the discharge container section 12, and is stored in it.

By the above-described operation, a monochromatic image formed of toner of one color is formed on one side of one piece of recording paper 19, and the basic image formation operation ends. When an instruction for performing image formation on more than one sheet is given, the above-described operational steps are similarly repeated for the number of pieces of recording paper.

Structure of Storage Device

Next, the storage device 5 will be described.

As shown, for example, from FIGS. 2 to 7, the storage device 5 is provided at a portion at one side of an internal panel 10*c* that is exposed when the front cover 15 of the housing 10 is opened, while the storage device 5 and the portion at the one side are disposed in a storage space of the housing 10.

First, as shown in, for example, FIG. 5, the developer container 9 that is stored in the storage device 5 includes a circular cylindrical body 91 and a disc-shaped cover portion 92. One side of the body 91 is open. The cover portion 92 is fitted to and covers the opening of the body 91.

A discharge opening 90*b* (see FIG. 7) that discharges toner (developer) is provided in a surface of a lower portion of the body 91. A slide shutter 93 for covering and uncovering the discharge opening 90*b* is provided at an outer peripheral surface of the body 91. In addition, a control memory element 94 that storages and updates (writes in) information required for, for example, the developer container 9 is provided on the outer peripheral surface of the body 91. Further, a position fixing protrusion 95 (see FIG. 8A) that fixes the position of the body 91 when the storage is completed is formed on the outer peripheral surface of the body 91. The cover portion 92 has the form of a disc with its central portion being depressed towards the body 91. A holding protrusion 96 that is held by a user with his/her fingertips is formed on the central portion of the cover portion 92.

As shown in, for example, FIGS. 2 and 4, the storage device 5 includes a storage body 50 having a storage space 51 that removably stores the developer container 9 as a result of pushing in and drawing out the developer container 9.

The container body 50 includes a circular cylindrical body frame 52 and an entrance frame 54. The body frame 52 has the circular cylindrical storage space 51. In the entrance frame 54, an entrance 53 of the storage space 51 of the body frame 52 is formed as a substantially circular through hole. The body frame 52 and the entrance frame 54 are provided so that the storage space 51 of the body frame 52 and the through hole, which corresponds to the entrance 52 of the entrance frame 54, are substantially connected to each other.

The body frame 52 is mounted while being connected to a top portion (toner receiving opening) of the toner replenishing device 17. A toner discharge connection opening is formed in a lower portion of the storage space 51 of the body frame 52. The toner discharge connection opening is connected to the toner receiving opening of the toner replenishing device 17 and transfers toner discharged from the developer container 9.

The entrance frame 54 is integrally formed as a portion of the internal panel 10*c* of the housing 10 (see FIG. 5). A square recessed portion that stores a opening/closing cover 60 (described later) in a closed state is formed at the entrance frame 54. Further, passage recessed portions 56*a*, 56*b*, and 56*c* that allow passage of the slide shutter 93, the control memory element 94, and the position fixing protrusion 95 are formed in correspondence with required positions of a portion of the entrance frame 54 that is situated around the through hole (entrance 53). The slide shutter 93, the control memory element 94, and the position fixing protrusion 95 exit in a state in which they protrude from the outer peripheral surface of the body 81 of the developer container 9.

As shown, for example, from FIGS. 4 to 7, the storage device 5 includes the opening/closing cover 60, serving as an exemplary cover member, that rotates around an end portion 60*a* (serving as a fulcrum and rotatably mounted to the storage body 50), and that causes the entrance 53 of the storage space 51 of the storage body 50 to be in a covered state and an uncovered state.

The opening/closing cover 60 according to the first exemplary embodiment is formed of a plate member having an area that is wider than that of the entrance 53 of the storage space 51 of the storage body 50, and having an overall substantially square shape. Support shafts 61 are provided on corresponding left and right side portions of a lower end portion 60*a* of the opening/closing cover 60. The support shafts 61 protrude for rotatably mounting the opening/closing cover 60 to the storage body 50. Further, a corner at one side of an upper end portion 60*b* of a front surface of the opening/closing cover 60 is provided with a catch 62 serving as a portion where a user places his/her finger tips. The catch 62 is bent so as to protrude towards the front side of the surface of the opening/closing cover 60. Incidentally, a recessed portion 16 is formed in an end portion of the internal panel 10*c* opposing the catch 62 of the opening/closing cover 60. The recessed portion 16 is deformed so as to be recessed towards a side opposite to the direction in which the catch 62 protrudes, and is a portion for helping the user place his/her fingertips on the catch 62.

When the support shafts 61 of the opening/closing cover 60 are rotatably fitted and mounted to shaft mounting holes 55 at the left and right sides of a lower end portion of the entrance frame 54 of the storage body 50, it is possible to rotate the opening/closing cover 60 around the support shafts 61 (serving as fulcra) at the lower end portion 60*a* in the directions of arrows C1 and C2. Therefore, when the upper end portion 60*b* (the catch 62 when the opening/closing cover 60 is open) is held to rotate the opening/closing cover 60, the opening/closing cover 60 causes the entrance 53 of the storage space 51 to be in an uncovered state or the entrance 53 of the storage space 51 to be in a covered state.

Figure 6:
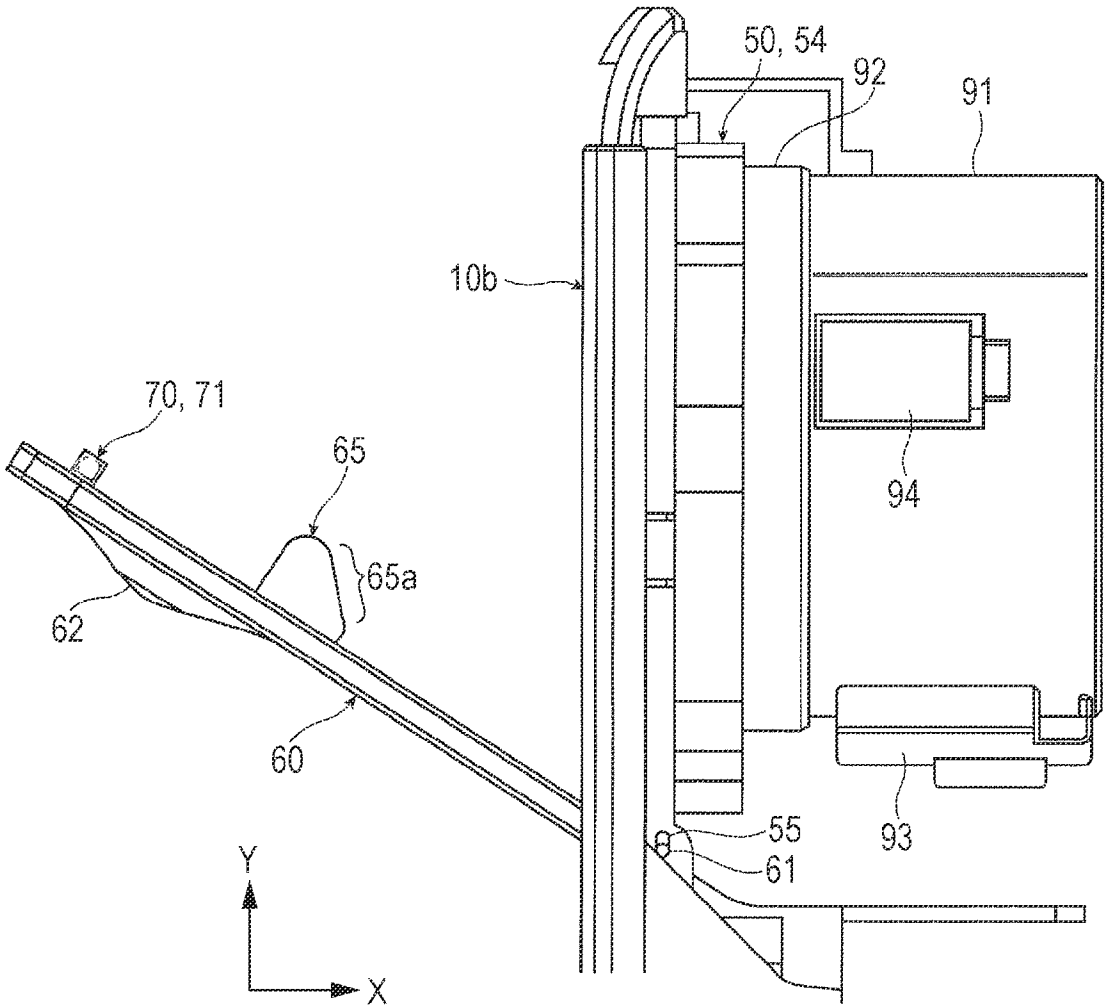
FIG. 6 is a side view of a portion in a state when the developer container is stored in the storage device shown in FIG. 5 and the opening/closing cover is open.
Figure 7:
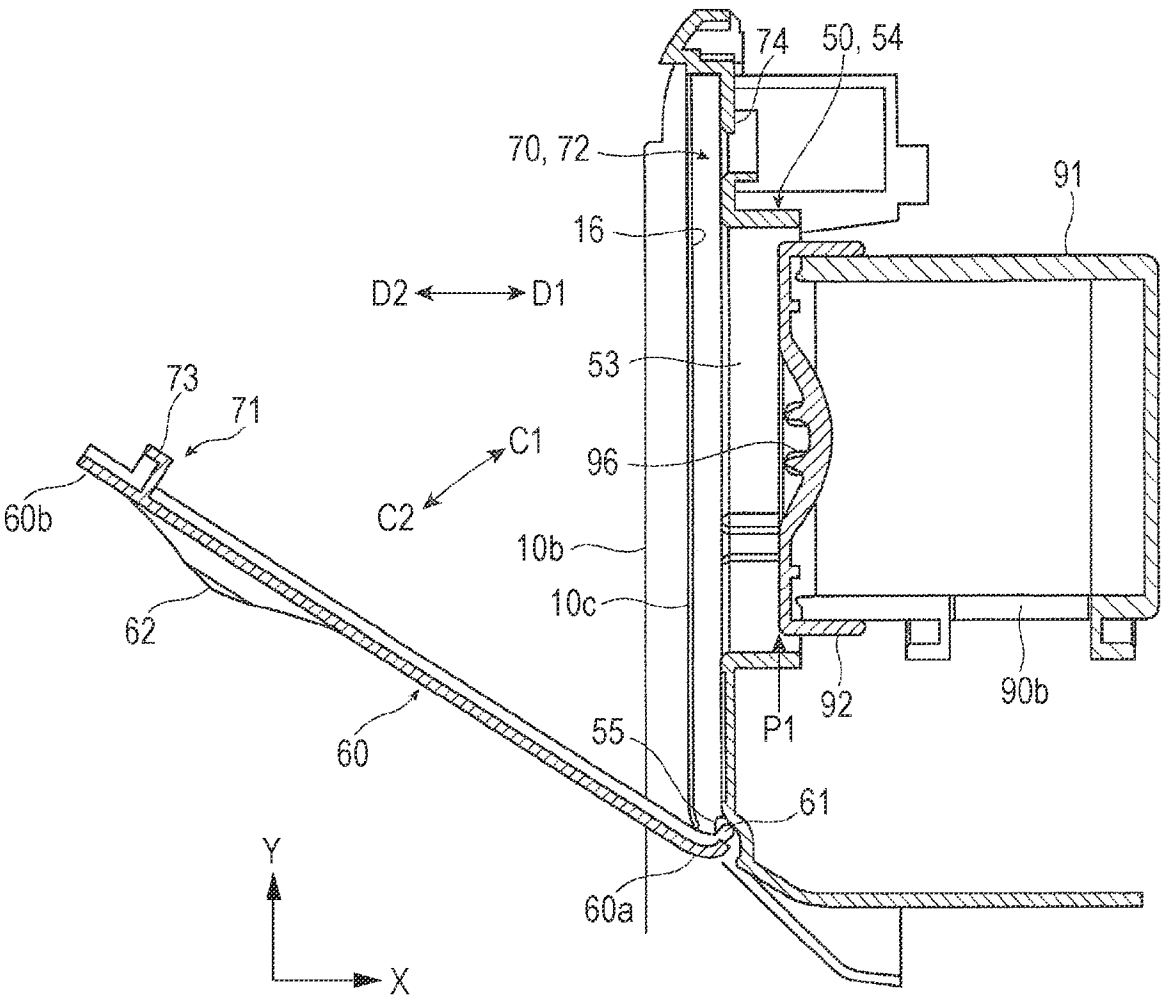
FIG. 7 is a sectional view showing a state of the storage device and a state of the developer container shown in FIG. 6 (taken along line VII-VII in FIG. 8A)

As shown, for example, from FIGS. 5 to 7, the storage device 5 includes a fixing mechanism 70 that fixes the opening/closing cover 60 to the storage body 50 (actually, the entrance frame 52) while the opening/closing cover 60 is in the closed state.

The fixing mechanism 70 according to the first exemplary embodiment includes a catch bending portion 71 and a catch receiving portion 72. The catch bending portion 71 serves as a bending portion formed in an extended state so as to protrude from the opening/closing cover 60. The catch receiving portion 72 serves as a holding portion formed in the storage body 50. When the opening/closing cover 60 rotates, the fixing mechanism 70 causes the opening/closing cover 60 to be in a fixed state (and an unfixed state) with respect to the storage body 50. More specifically, the fixing mechanism 70 is such that the catch bending portion 71 having an L shape in cross section is formed on an upper end portion of a back surface of the opening/closing cover 60, and the catch receiving portion 72 having a shape that allows the catch bending portion 71 to overlap and be caught by the catch bending portion 71 is formed at an upper end portion of the storage body 50 excluding the location where the entrance 53 of the entrance frame 54 is formed and opposing the catch bending portion 71. The entire catch bending portion 71 has the shape of a box having an open upper side, with one side surface portion of the catch bending portion 71 that is parallel to the back surface of the opening/closing cover 60 being formed as a catch surface portion 73. The catch receiving portion 72 has a rectangular opening that is formed in a portion of the entrance frame 54 that opposes the catch bending portion 71 when the opening/closing cover 60 is closed. The opening allows entry of the catch bending portion 71. The catch receiving portion 72 is provided with a catch receiving surface portion 74 at the top side of the opening. The catch receiving surface portion 74 faces downward in the direction of gravitational force.

The catch bending portion 71 and the catch receiving portion 72 of the fixing mechanism 70 are such that, when the opening/closing cover 60 is closed, the catch surface portion 73 of the catch bending portion 71 and the catch receiving surface portion 74 of the catch receiving portion 72 overlap each other by a required amount (catch amount $\alpha$1, strictly speaking, the area; see FIG. 11A), contact each other, and are in a caught state. Reference numeral 75 in, for example, FIG. 5 denotes a regulating protrusion that, when the opening/closing cover 60 is being closed, stops and regulates the opening/closing cover 60 at a location where the caught state of the catch bending portion 71 and the catch receiving portion 72 of the fixing mechanism 70 is maintained.

Basic Operation of Storage Device

The state of use, operation, etc. of the storage device 5 will hereunder be described.

First, when the developer container 9 is to be stored in the storage device 5, as shown in, for example, FIGS. 4 and 5, while a user places his/her fingertips on the catch 62, the user rotates the opening/closing cover 60 around the support shafts 61 (serving as fulcra) in the direction of arrow C2, so that the entrance 53 of the storage space 51 (entrance frame 54) of the storage body 50 is in an uncovered state. Then, the developer container 9 is pushed in the direction of arrow D1 towards an inner side of the storage space 51 from the uncovered entrance 53. As shown in, for example, FIGS. 6 and 7, this causes the entire developer container 9 (the body 91 and the cover portion 92) to be pushed into and stopped at a required storage position in the storage space 51 of the storage body 50. Symbol P1 in, for example, FIG. 7 denotes a storage stopping position (first position) when the cover portion 92 of the developer container 9 serves as a reference.

Figure 8A:
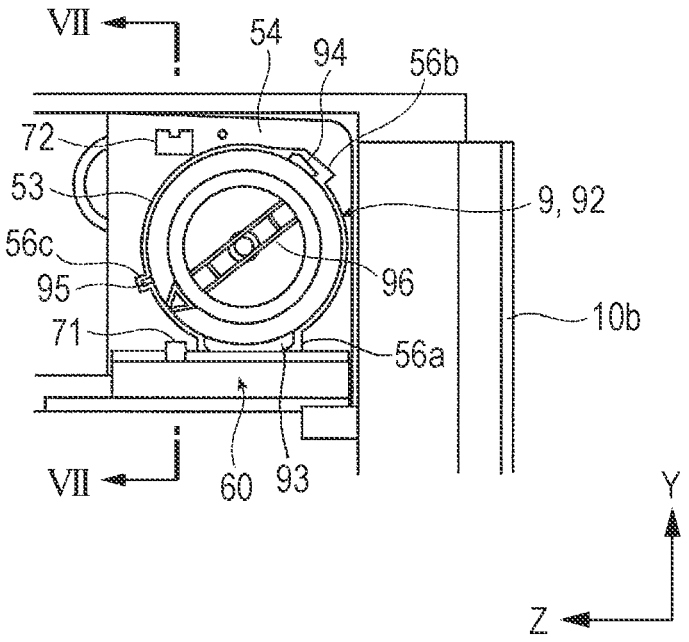
FIG. 8A is an explanatory view of a state in which the developer container that is stored in a storage space is not fixed to the storage device (unfixed state)

Here, at a stage directly after the developer container 9 has been pushed into the storage space 51 of the storage body 50, as shown in FIG. 8A, the position fixing protrusion 95, provided at the body 91 of the developer container 9, is at a position that is aligned with the position of the passage recessed portion 56*c*, formed in the entrance frame 54 of the storage body 50. At this time, the developer container 9 is in a state in which its position is not fixed with respect to the storage space 51 of the storage body 50 (unfixed state). The developer container 9 that is in the unfixed state is capable of being drawn out from the storage space 51 of the storage body 50 by holding the holding protrusion 96 of the cover portion 92 and puling it in the direction of arrow D2.

Figure 8B:
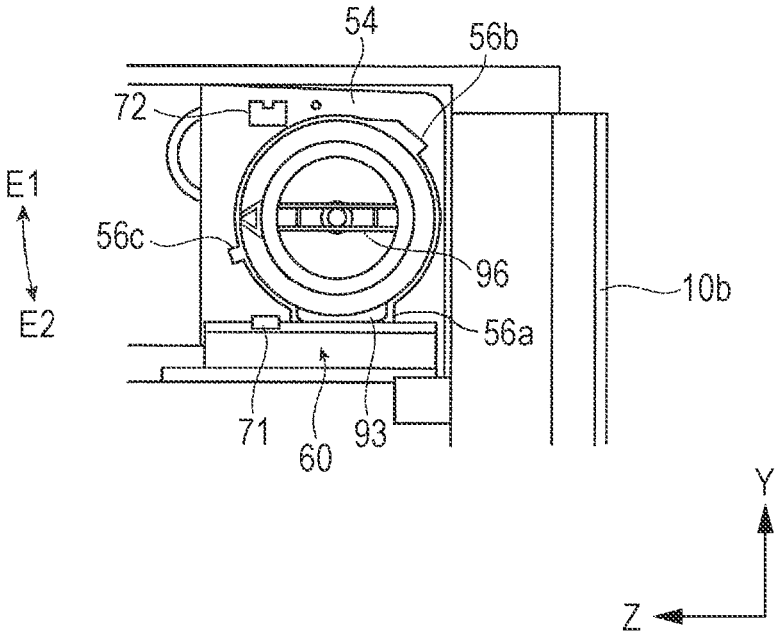
FIG. 8B is an explanatory view of a state in which the developer container that is stored in the storage space is fixed to the storage device (fixed state)

After pushing the developer container 9 into the storage space 51 of the storage body 50, the user holds the holding protrusion 96 and rotates the entire developer container 9 in the direction of arrow E1 in the storage space 51. As shown in, FIG. 8B, this causes the position fixing protrusion 95 to be displaced from the passage recessed portion 56*c*. As a result, the position of the developer container 9 with respect to the storage space 51 of the storage body 50 is in a fixed state. Incidentally, when the developer container 9 is rotated in the direction of arrow E1 (that is, the direction in which the developer container 9 is caused to be in a fixed state), the slide shutter 93 moves relative to the storage body 50 that rotates and (while the developer container 9 is actually stopped at the position that is reached after the slide shutter 93 has passed the passage recessed portion 56*a*), the discharge opening 90*b* of the body 91 is uncovered, so that the developer container 9 is connected to the toner replenishing device, and the control memory element 94 faces a memory read/write device (head) (not shown) that is disposed in the housing 10.

Figure 9:
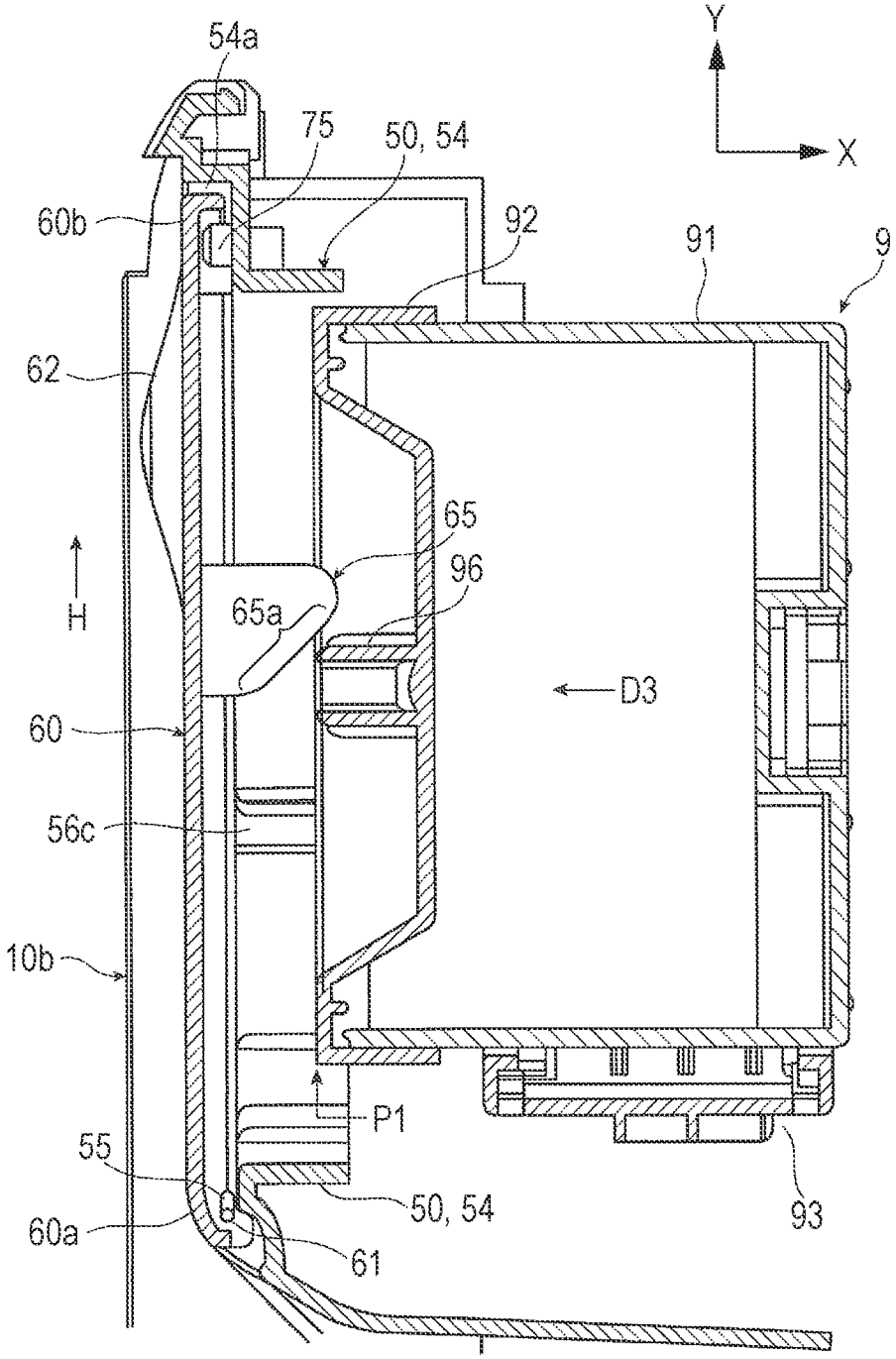
FIG. 9 is a sectional view of a principal structural portion of the storage device according to the first exemplary embodiment.
Figure 10:
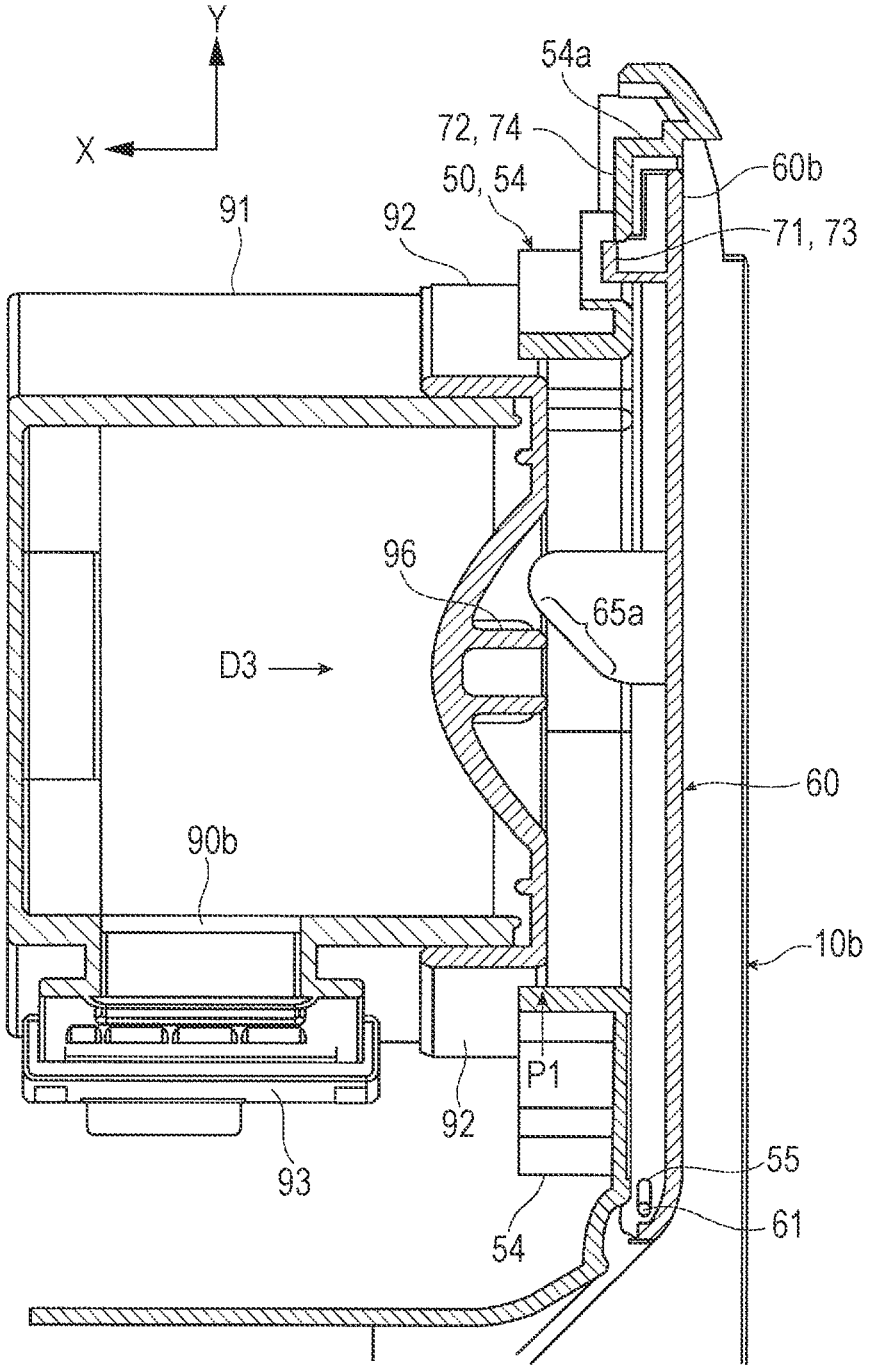
FIG. 10 is a sectional view of the principal structural portion of the storage device shown in FIG. 9, the principal structural portion being sectioned at a different portion.

Next, in the storage device 5, ordinarily, after the developer container 9 has been set in the fixed state with respect to the storage space 51 of the storage body 50, as shown in FIGS. 9 and 10, the opening/closing cover 60 is rotated around the support shafts 61 (serving as fulcra) in the direction of arrow C1, so that the entrance 53 of the entrance frame 54 of the storage body 50 is set in a covered state.

Here, as shown in FIG. 9, the closing operation of the opening/closing cover 60 is finally stopped when the back surface of the upper end portion 60*b* of the opening/closing cover 60 collides with the regulating protrusion 75, provided on the entrance frame 54. Before the upper end portion 60*b* collides with the regulating protrusion 75, as shown, for example, from FIGS. 10 to 12, the catch bending portion 71 of the fixing mechanism 70 that is situated at the upper end portion 60*b* is caused to be in a state in which it is caught by the catch receiving portion 72 of the fixing mechanism 70 that is situated at the entrance frame 54 of the storage body 50.

Figure 11B:
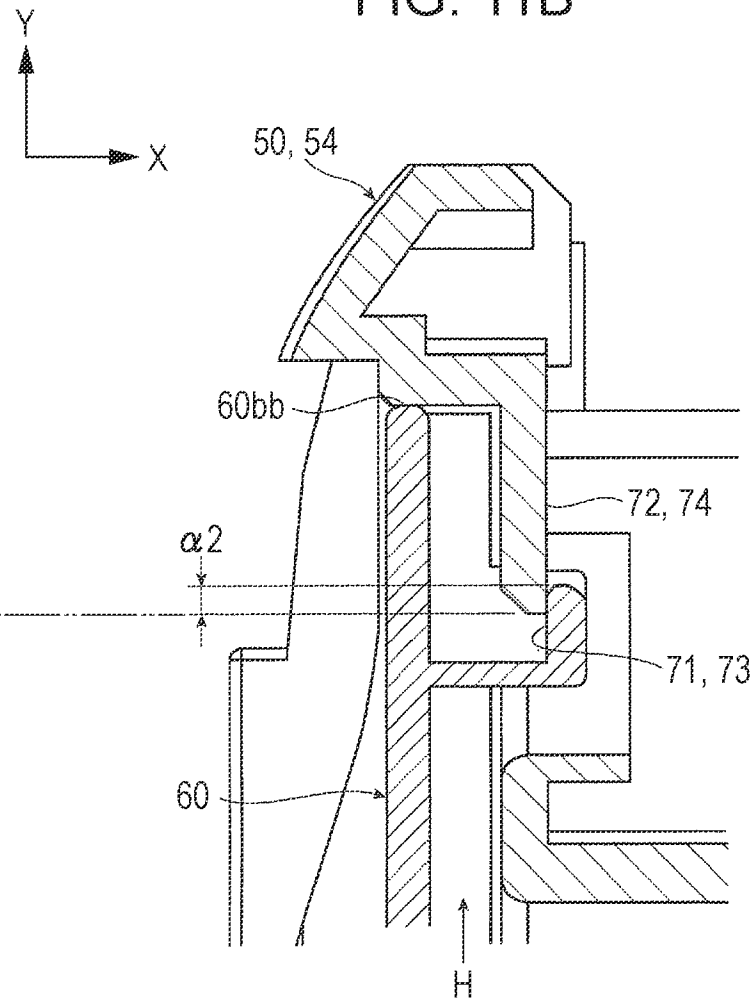
FIG. 11B is an enlarged explanatory view showing a caught state in the fixing mechanism when the developer container in the storage device shown in FIG. 9 is moved (state in which a catch amount is increased)
Figure 11A:
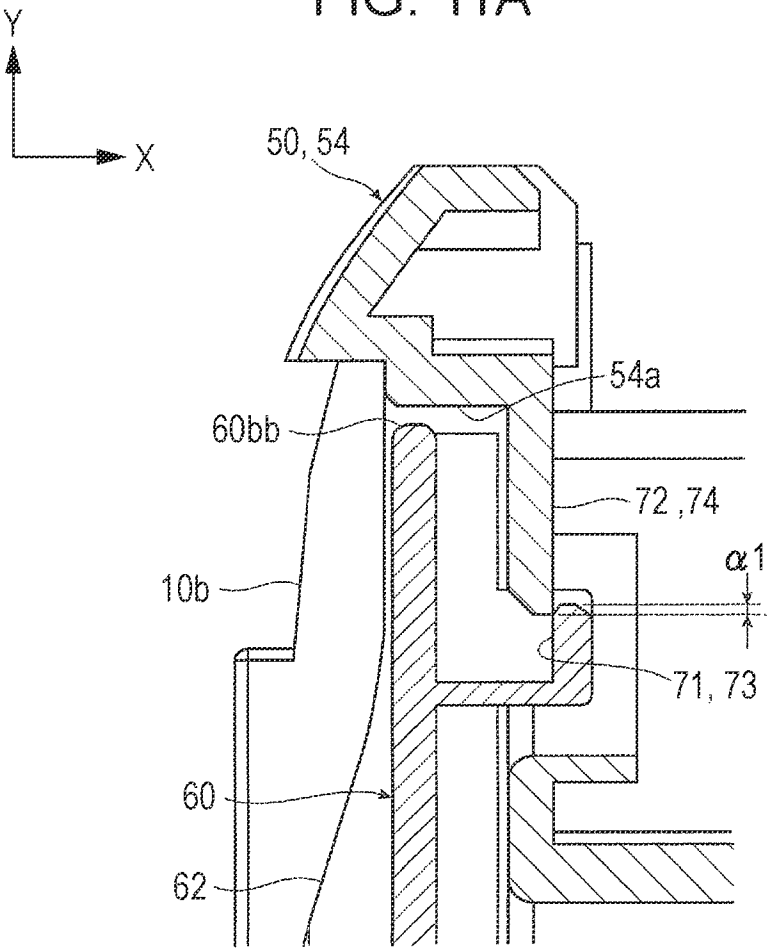
FIG. 11A is an enlarged explanatory view showing a caught state in a fixing mechanism in a normal state of the storage device shown in FIG. 9.
Figure 12B:
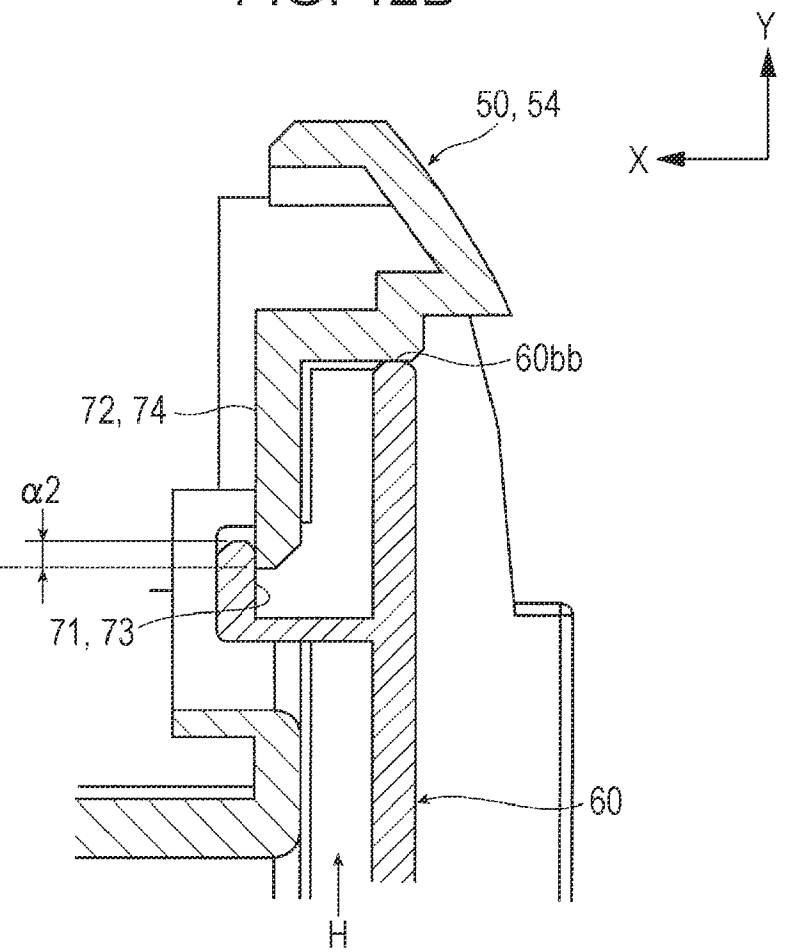
FIG. 12B is an enlarged explanatory view showing the caught state in the fixing mechanism when the developer container in the storage device shown in FIG. 10 is moved (state in which the catch amount is increased)
Figure 12A:
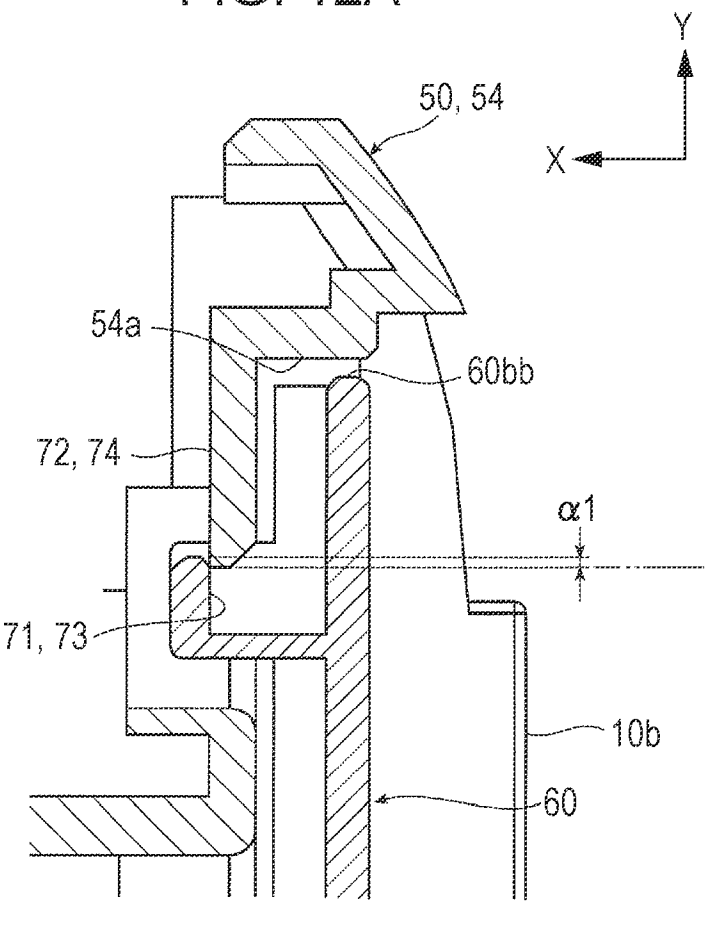
FIG. 12A is an enlarged explanatory view showing the caught state in the fixing mechanism in the normal state of the storage device shown in FIG. 10.

That is, as shown in enlarged form in FIGS. 11A and 12A, the catch surface portion 73 of the catch bending portion 71 of the opening/closing cover 60 is temporarily elastically deformed and slides to the back surface of the catch receiving surface portion 74 of the catch receiving portion 72 of the entrance frame 54, and is caused to overlap and contact by a required area the back surface of the catch receiving surface portion 74. The portion (area) where the catch surface portion 73 overlaps and contacts the catch receiving surface portion 74 corresponds to a catch amount $\alpha$1 of the catch bending portion 71 with respect to the catch receiving portion 72. Incidentally, an upper end portion of the catch surface portion 73 and a lower end portion of the catch receiving surface portion 74 have corresponding tapered surfaces (inclined surfaces) that are parallel to each other, with an end portion of each tapered surface being rounded. This allows the catch surface portion 73 to easily and smoothly move to the back surface of the catch receiving surface portion 74, so that the catch surface portion 73 is caused to easily overlap and contact (be caught by) the catch receiving surface portion 74. From the viewpoint of, for example, facilitating setting of the catch bending portion 71 to a caught state by the catch receiving portion 72 and setting thereof to an uncaught state, the catch amount $\alpha$1 is set to the minimum amount required.

Therefore, as shown in, for example, FIGS. 3, 9, and 10, the opening/closing cover 60 is fixed to the entrance frame 54 of the storage body 50, so that the entrance 53 of the storage space 51 in which the developer container 9 is stored is maintained in the covered state. As a result, the storage operation of the developer container 9 into the storage device 5 is completed.

Next, when the developer container 9 is to be taken out from the storage device 5, while the user places his/her fingertips on the catch 62, the user rotates the opening/closing cover 60 in the direction of arrow C2, so that the entrance 53 of the storage space 51 (entrance frame 54) of the storage body 50 is caused to be in an uncovered state (see, for example, FIGS. 4 and 5).

Here, the state of the catch bending portion 71 of the fixing mechanism 70, which is situated on the upper end portion 60*b* of the opening/closing cover 60, is changed from the state in which it is caught by the catch receiving portion 72 of the fixing mechanism 70, which is situated at the entrance frame 54 of the storage body 50, to a state in which it is not caught by the catch receiving portion 72. That is, the catch surface portion 73 of the catch bending portion 71 of the opening/closing cover 60 is temporarily elastically deformed and moves out from the back side of the catch receiving surface portion 74 of the catch receiving portion 72 of the entrance frame 54 towards the front side of the catch receiving surface portion 74. As a result, the catch surface portion 73 is no longer in the state in which it overlaps and contacts the back surface of the catch receiving surface portion 74 (see, for example, FIG. 7).

This causes the state of the opening/closing cover 60 to be switched from the fixed state in which it is fixed to the storage body 50 (entrance frame 54) to the unfixed state in which it is not fixed to the storage body 50, and the entrance 53 of the storage space 51 to be in the uncovered state. In addition, a portion (cover portion 92) of the developer container 9 that is stored in the storage space 51 is caused to be in an exposed state (see, for example, FIG. 8B).

Next, when the user holds the holding protrusion 96 and rotates the entire developer container 9 in the direction of arrow E2 in the storage space 51, as shown in FIG. 8A, the position fixing protrusion 95 is moved to a position in which it is aligned with the passage recessed portion 56*c*. As a result, the position of the developer container 9 with respect to the storage space 51 of the storage body 50 is changed from where the developer container 9 is fixed to where the developer container 9 is unfixed.

Lastly, the user draws out the developer container 9 in the direction of arrow D2 from the interior of the storage space 51 through the uncovered entrance 53 (see, for example, FIGS. 5 and 7). As a result, the taking out of the developer container 9 from the storage device 5 is completed.

Detailed Structure of Storage Device

For example, when the image forming apparatus 1 is shipped or is moved and transported for a long period of time, the storage device 5 may be moved or set while the developer container 9 is unfixed with respect to the storage space 51 in the storage body 50 (see FIG. 8A). This is to prevent contamination caused when toner that is contained in the developer container 9 is vibrated during movement of the image forming apparatus 1 and falls naturally and is discharged, as a result of which, for example, the toner is spilt into the storage space 51 of the storage device 5 or the interior of the housing 10 of the image forming apparatus 1, when, for example, the developer container 9 is fixed with respect to the storage space 51 in the storage body 50 (see FIG. 8B) and the discharge opening 90*b* of the developer container 9 and a take-in opening of the toner replenishing device 17 are connected to each other.

However, when the developer container 9 is unfixed with respect to the storage space 51 in the storage body 50 (see FIG. 8A), if the image forming apparatus 1 is subjected to a strong shock or vibration during, for example, the movement thereof, or when the image forming apparatus 1 (including the storage device 5) is tilted, the developer container 9 that is not fixed in the storage space 51 in the storage body 50 may collide with the opening/closing cover 60 by moving from its proper storage fixed position P1 to a position P2 or a position P3 where the developer container 9 contacts the opening/closing cover 60 (see FIGS. 13 and 14: second positions) by moving closer to it. In this case, the state of the opening/closing cover 60 is switched from the state in which it is fixed by the fixing mechanism 70 to the unfixed state in which it is open. Therefore, the developer container 9 may be ejected to the outside from the storage space 51. That is, such a phenomenon occurs because, for example, since the fixed state (catch amount $\alpha 1$) of the opening/closing cover 60 that is fixed using the fixing mechanism 70 is set relatively weak (is set small) from the viewpoint of, for example, facilitating the opening/closing of the opening/closing cover 60, collision of the developer container 9 with the opening/closing cover 60 causes the opening/closing cover 60 to be relatively easily set from the fixed state by the fixing mechanism 70 into the unfixed state.

Therefore, the storage device 5 is formed so as to have the following structure from the viewpoint of preventing the developer container 9 from being ejected when the opening/closing cover 60 opens as a result of, for example, collision with the opening/closing cover 60 or holding of the developer container 9 in a tilted manner, occurring due to the movement of the developer container 9. However, a structure that sacrifices the facility with which the opening/closing cover 60 is opened and closed (such as a structure in which the strength for setting the opening/closing cover 60 to the fixed state using the fixing mechanism 70 is increased) is not used.

That is, in the storage device 5, when the developer container 9 moves to the second position P2 (P3) from the first position P1 (which corresponds to the proper storage fixed position), the fixing mechanism 70 causes the opening/closing cover 60 to be more firmly fixed than when the developer container 9 is stopped at the first position P1.

In the storage device 5 according to the first exemplary embodiment, when the developer container 9 has moved from the first position P1 to the second position P2 (P3), the developer container 9 contacts a portion of the opening/closing cover 60, so that the fixing mechanism 70 causes the opening/closing cover 60 to be more firmly fixed. That is, in the storage device 5 according to the first exemplary embodiment, the opening/closing cover 60 is movable in a specific direction (first direction) in which the opening/closing cover 60 is more firmly fixed using the fixing mechanism 60 while the opening/closing cover 60 covers the entrance 53 of the storage space 51 in the storage body 50. Moreover, when momentum that is provided when the developer container 9 moves from the first position P1 to the second position P2 (P3) is converted into momentum that is required for moving the opening/closing cover 60 in the specific direction, the opening/closing cover 60 is fixed more firmly by the fixing mechanism 70.

In the storage device 5 according to the first exemplary embodiment, more specifically, as shown, for example, from FIGS. 5 to 7 and FIGS. 9 to 11, the opening/closing cover 60 is mounted on the storage body 50 so as to be displaceable in the direction of arrow H in which the catch amount $\alpha$ of the catch bending portion 71 with respect to the catch receiving portion 72 of the fixing mechanism 70 (strictly speaking, the area of a region where the catch bending portion 71 and the catch receiving portion 72 oppose each other) is increased when the entrance 53 of the storage space 51 is covered. In addition, at the storage device 5, a displacement inducing portion 65 is provided on the back surface of the opening/closing cover 60. The displacement inducing portion 65 contacts a portion of the developer container 9 when it moves towards the entrance 53 at the storage space 51 of the storage body 50 and displaces the opening/closing cover 60 in the direction of arrow H (in which the catch amount $\alpha$ increases) in response to the movement of the developer container 9 with which the displacement inducing portion 65 has contacted to the position where the developer container 9 contacts the displacement inducing portion 65 by moving closer to the entrance 53 (or the opening/closing cover 60).

As shown in FIGS. 6, 7, 9, and 10, for mounting the opening/closing cover 60, the shaft mounting holes 55 to which the support shafts 61 (disposed at the lower end portion of the opening/closing cover 60) are fitted and mounted and that are formed at the entrance frame 54 are provided as long holes that are relatively long in the direction of arrow H in which the catch amount α increases. As shown from FIGS. 9 to 12, of recessed portions of the entrance frame 54 that are used to store the opening/closing cover 60 in the closed state, an upper end portion 54*a* that faces an end portion 60*bb* of the upper end portion 60*b* of the opening/closing cover 60 is formed so as to exist at a location that does not become an obstacle to the end portion 60*bb* even if the end portion 60*bb* is displaced in the direction of arrow H in which the catch amount α increases.

As shown in FIGS. 9 and 10, when the opening/closing cover 60 that is mounted in this way covers the entrance 53, the support shafts 61 are positioned so as to exist towards a lower end portion 55*a* defining the long shaft mounting holes 55 due to their own weight. At this time, the end portion 60*bb* at the upper end portion of the opening/closing cover 60 exists and is held at a position that is separated from the upper end portion 54*a* at the recessed portion of the entrance frame 54 by a required distance.

As shown in, for example, FIGS. 9 and 10, the displacement inducing portion 65 is formed by providing a plate member at a portion of the back surface of the opening/closing cover 60 that faces and contacts the holding protrusion 96 at the cover portion 92 of the developer container 9 when the opening/closing cover 60 is closed. The plate member protrudes towards the holding protrusion 96 (in the same direction as the direction of arrow D1, that is, the push-in direction). A portion 65*a* of the displacement inducing portion 65 that contacts the holding protrusion 96 of the developer container 9 is formed as an inclined portion that obliquely crosses the direction of arrow D3 in which the developer container 9 moves towards the entrance 53.

Incidentally, as shown in, for example, FIGS. 9 and 10, when the developer container 9 is at the proper storage stopping position P1, the inclined portion 65*a* of the displacement inducing portion 65 faces the holding protrusion 96 of the developer container 9 so as to be spaced apart by a required distance.

Operation of Structure of Storage Device Described in Detail

Next, the operation of the storage device 5 using the detailed structure is described.

First, in the storage device 5, when the developer container 9 is unfixed with respect to the storage space 51 in the storage body 50 (see FIG. 8A), and the opening/closing cover 60 is closed to maintain the fixed state of the opening/closing cover 60 using the fixing mechanism 70, the developer container 9 may move towards the entrance 53 in the direction of arrow D3 due to, for example, any of the above-described factors.

Figure 13A:
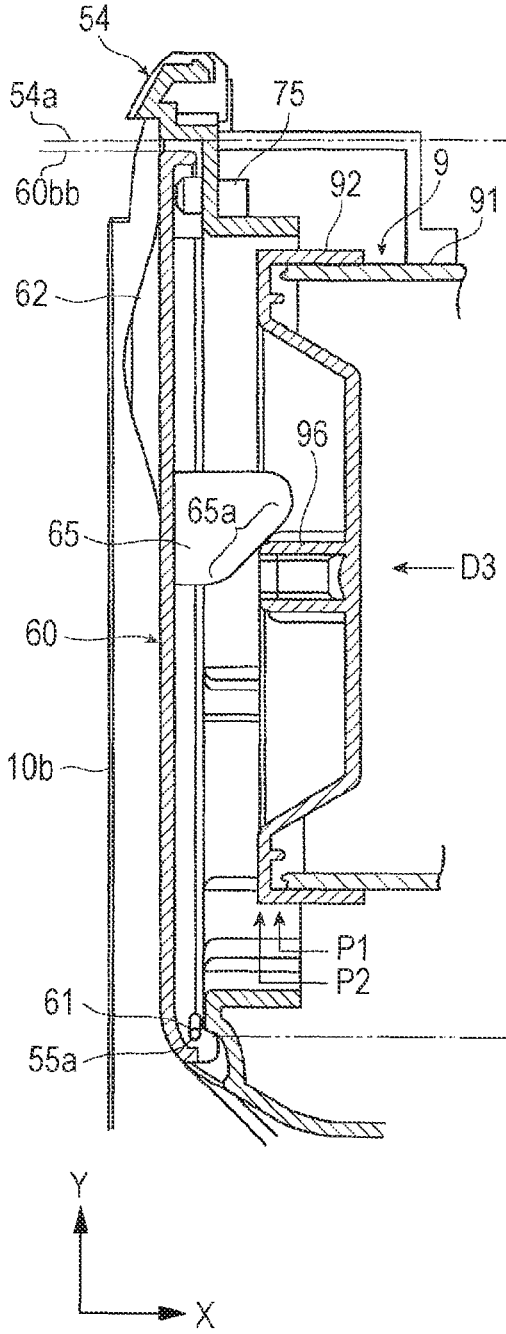
FIG. 13A is an explanatory view showing a state in which the developer container in the storage device shown in FIG. 9 is moved slightly towards an entrance and contacts a displacement inducing section.
Figure 13B:
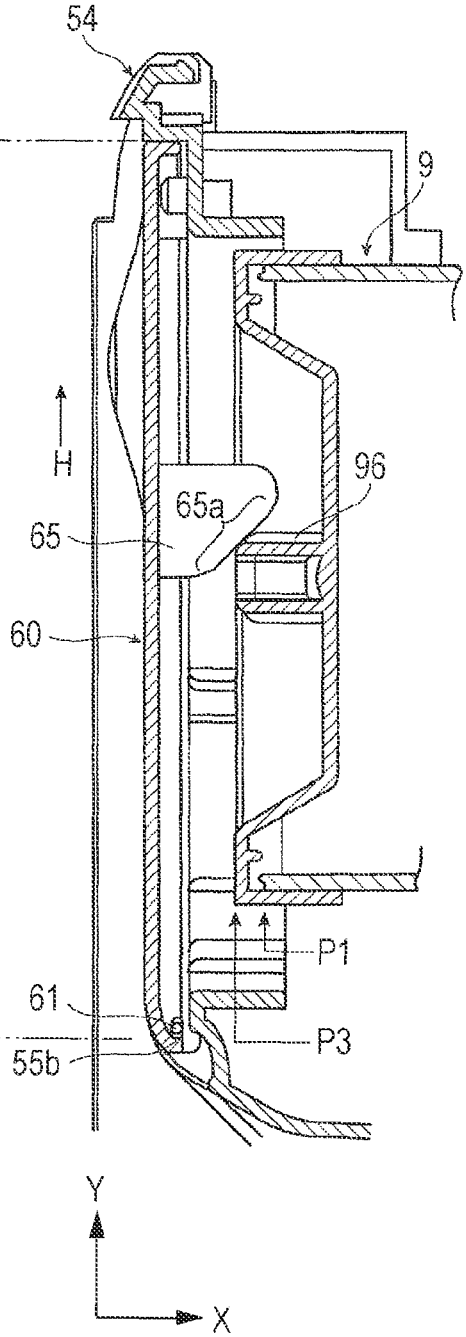
FIG. 13B is an explanatory view showing a state when the developer container in the storage device shown in FIG. 9 is further moved towards the entrance.
Figure 14A:
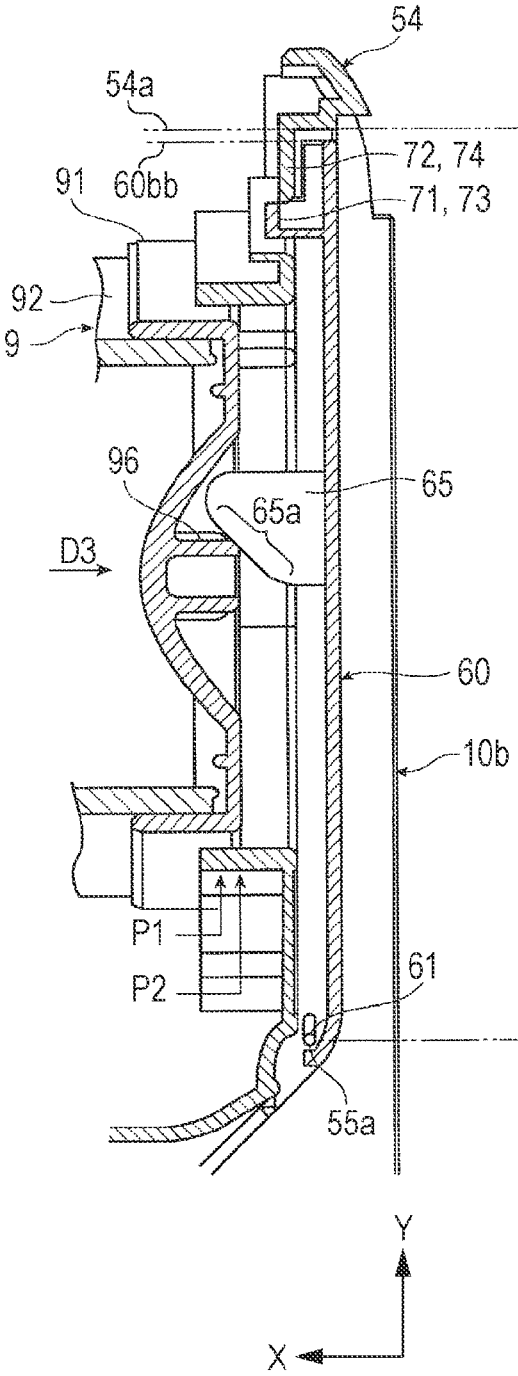
FIG. 14A is an explanatory view showing a state when the developer container in the storage device shown in FIG. 10 is moved slightly towards the entrance.
Figure 14B:
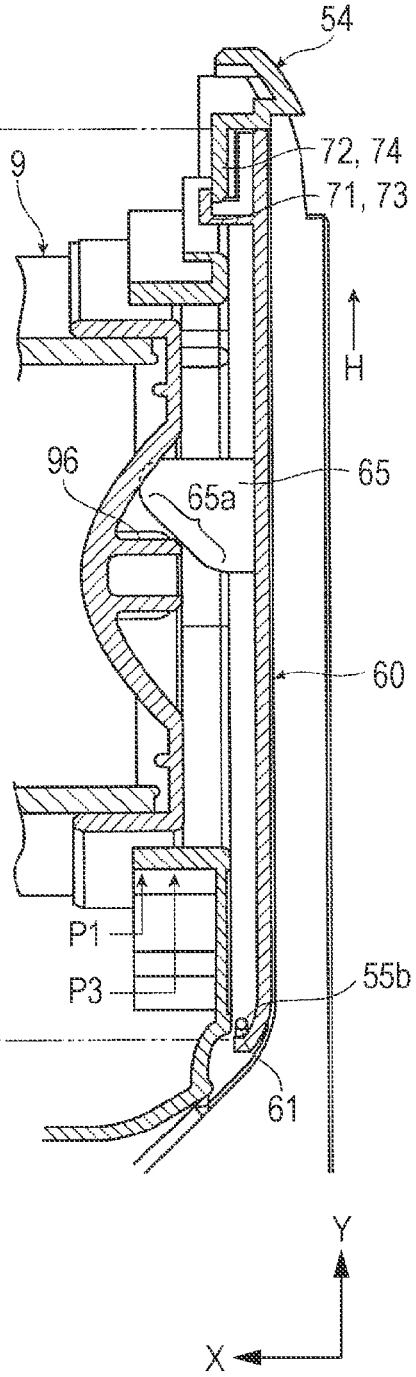
FIG. 14B is an explanatory view showing a state when the developer container in the storage device shown in FIG. 10 is further moved towards the entrance.

In this case, as shown in, for example, FIGS. 13A and 14A, when the developer container 9 moves from its proper storage stopping position P1 to the position P2 where the developer container 9 contacts the opening/closing cover by moving slightly towards it, (a portion) of the holding protrusion 96 of the developer container 9 contacts a portion of the inclined portion 65*a* of the displacement inducing portion 65 at the opening/closing cover 60. Next, when the developer container 9 moves from the proper storage stopping position P1 to the position P3 where it continues contacting the opening/closing cover 60 as a result of moving even closer to the opening/closing cover 60, as shown in, for example, FIGS. 13B and 14B, the holding protrusion 96 of the developer container 9 advances while pushing upward the inclined portion 65*a* of the displacement inducing portion 65 of the opening/closing cover 60.

Here, the displacement inducing portion 65 acts so that linear motion of the developer container 9 in the direction of arrow D3 in which the developer container 9 moves towards the entrance 63 is converted into linear motion that displaces the opening/closing cover 60 in the upward direction (H) that is substantially orthogonal to the linear motion in the direction of arrow D3. As shown in, for example, FIGS. 13B and 14B, in response to the movement of the developer container 9 towards the entrance 63, the displacement inducing portion 65 displaces the opening/closing cover 60 in the direction of arrow H in which the catch amount α increases. At this time, the support shafts 61 are displaced towards the upper end portion 55*b* of the long shaft mounting hole 55, and the end portion 60*bb* at the upper end portion of the opening/closing cover 60 is displaced to a position where it is close to the upper end portion 54*a* of the entrance frame 54 or to a position where it contacts the upper end portion 54*a* of the entrance frame 54.

As a result, as shown in, for example, FIGS. 11B and 12B, a portion where the catch surface portion 73 of the catch bending portion 71 of the fixing mechanism 70 at the opening/closing cover 60 overlaps and contacts the catch receiving surface portion 74 of the catch receiving portion 72 of the fixing mechanism 70 at the entrance frame 54 (that is, the area of this portion) increases. Therefore, the catch amount α of the catch bending portion 71 is increased. In the first exemplary embodiment, a catch amount α1 prior to the displacement is increased to a catch amount α2 (α2>α1).

Consequently, in the storage device 5, since the catch amount α1 of the fixing mechanism 70 is increased from α1 to α2, the opening/closing cover 60 is more firmly fixed in correspondence with the increased amount than when the developer container 9 is stopped at the first position P1. Thus, the opening/closing cover 60 is in a state in which it does not easily open. In other words, the momentum that is provided when the developer container 9 moves from the first position P1 to the second position P2 (P3) is converted into momentum that is required for moving the opening/closing cover 60 in the specific direction of arrow H, so that the fixing mechanism 70 in the storage device 5 causes the opening/closing cover 60 to be more firmly fixed. This maintains the opening/closing cover 60 in a state in which the opening/closing cover 60 is kept in the fixed state by the fixing mechanism 70 and does not easily open. Since the opening/closing cover 60 is not open, the developer container 9 is not ejected to the outside from the storage space 51 in the storage body 50.

Incidentally, when subsequently opening the opening/closing cover 60, the user only needs to return the catch amount α of the catch bending portion 71 to the ordinary catch amount by forcefully displacing the opening/closing cover 60 in a direction opposite to the direction of arrow H in which the catch amount α increases, or in a direction in which the developer container 9 moves away from the entrance 53 (or the opening/closing cover 60). By this, the opening/closing cover 60 is relatively weakly fixed by the fixing mechanism 70, so that the opening/closing cover 60 is capable of being easily opened and closed.

Second Exemplary Embodiment

Figure 15:
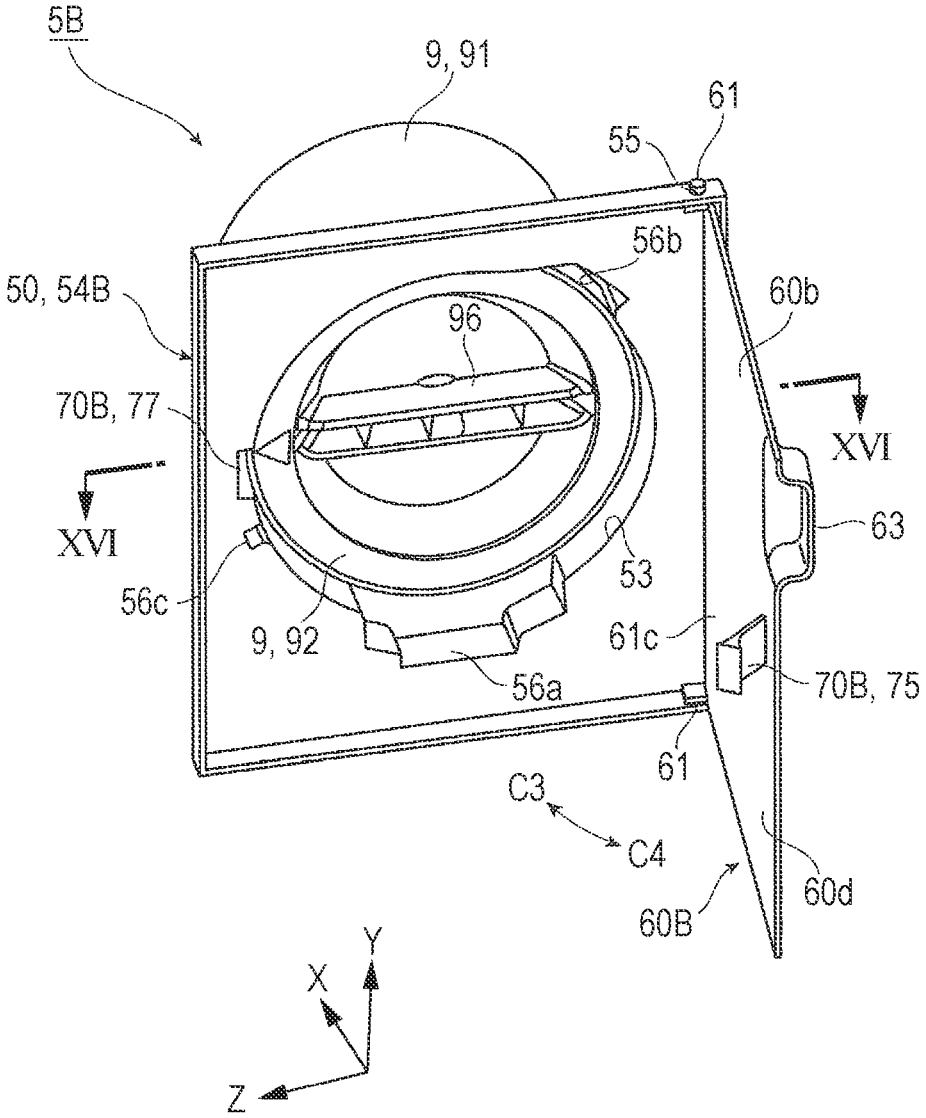
FIG. 15 is a perspective view of a principal portion of a storage device according to a second exemplary embodiment.
Figure 16:
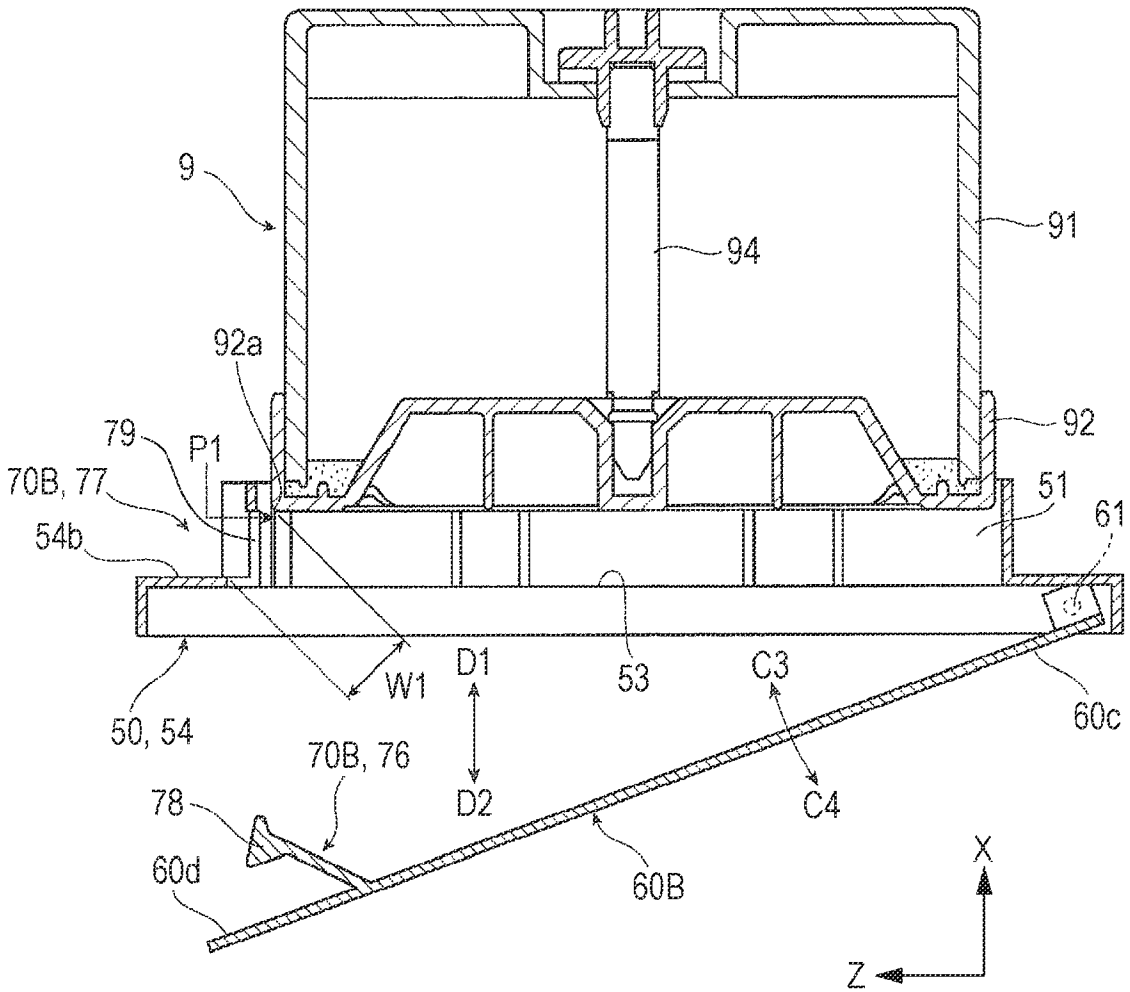
FIG. 16 is a schematic sectional view taken along line XVI-XVI of the storage device shown in FIG. 15.
Figure 17:
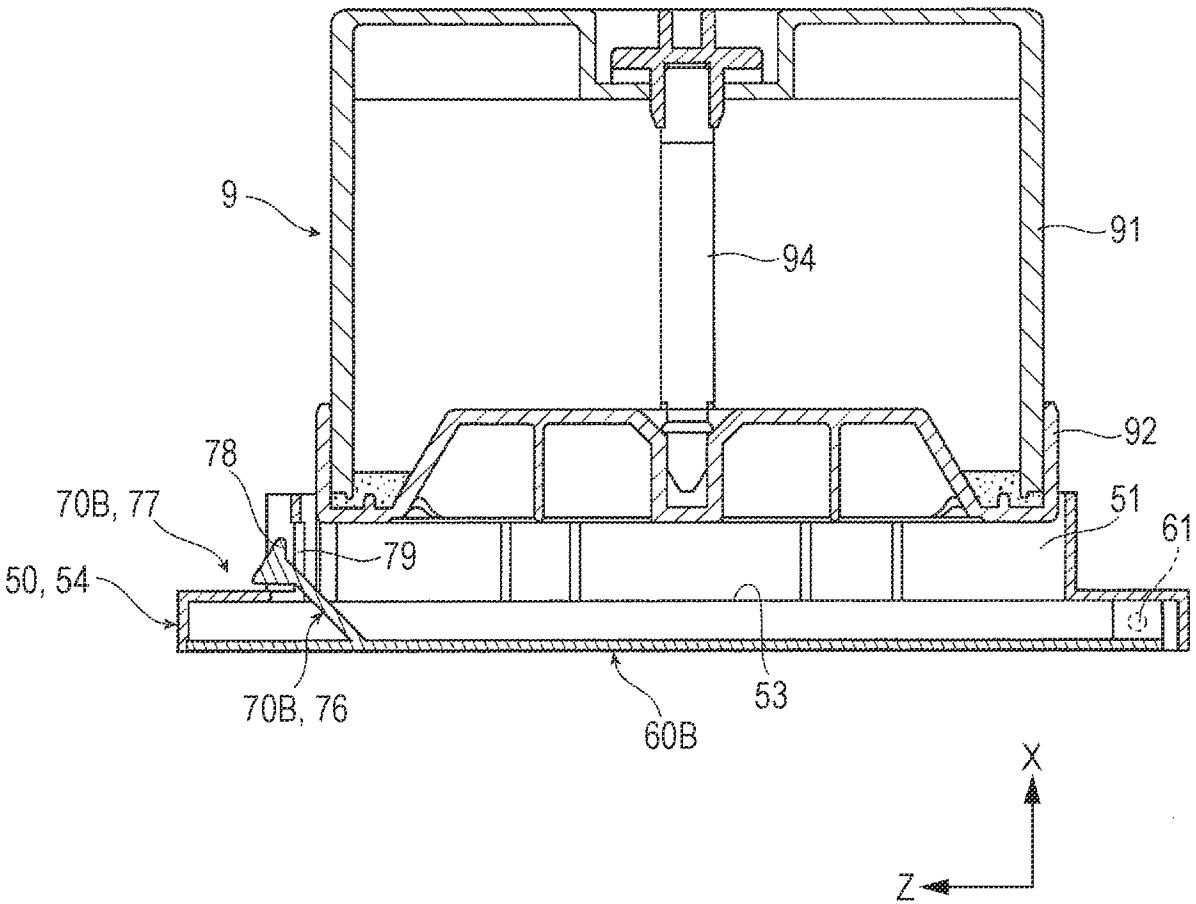
FIG. 17 is a schematic sectional view showing a state when the opening/closing cover of the storage device shown in FIG. 16 is closed.

A portion of a storage device 5B according to a second exemplary embodiment is shown from FIGS. 15 to 17. FIG. 15 shows, for example, a portion of a storage body 50 and an opening/closing cover 60B at the storage device 5B. FIG. 16 shows a state when the opening/closing cover 60B of the storage device 5B is open. FIG. 17 shows a state when the opening/closing cover 60B of the storage device 5B is closed.

As described below, the storage device 5B according to the second exemplary embodiment has the same structure as the storage device 5 according to the first exemplary embodiment except that a portion of the opening/closing cover 60B and a fixing mechanism 70B are different. Reference numeral 94 in, for example, FIG. 16 denotes a member that rotates to stir toner that is stored in a body 91 of a developer container 9. The detailed structure thereof will not be illustrated.

In the opening/closing cover 60B at the storage device 5B, outwardly protruding support shafts 61 are provided on upper and lower end portions at one of left and right end portions (that is, the right end portion 60*c*) of a substantially square plate member. A catch 63 whose shape is formed by bending so as to protrude towards a front side is provided on a left corner of an upper end portion 60*b* of a surface of the plate member. The opening/closing cover 60B is mounted by rotatably fitting the support shafts 61 to corresponding shaft mounting holes 55 that are provided in corresponding upper and lower sides of a right end portion of an entrance frame 54 of the storage body 50. This allows the opening/closing cover 60B to rotate around the support shafts 61 (serving as fulcra) at the right end portion 60*c* in the directions of arrows C3 and C4. By holding and rotating a left end portion 60*d* (the catch 63 when the opening/closing cover 60B is open), an entrance 53 of a storage space 51 in the storage body 50 is caused to be in an uncovered state or in a covered state.

The fixing mechanism 70B at the storage device 5B includes a catch portion 76 and a catch receiving portion 77. The catch portion 76 serving as a bent portion is formed at the opening/closing cover 60B in a protruded and extended state from the back surface of the opening/closing cover 60B. The catch receiving portion 77 serving as a holding portion is formed at a portion of the entrance 53 of the storage space 51 in the storage body 50. By rotating the opening/closing cover 60B, the opening/closing cover 60B is caused to be in a fixed state (and an unfixed state) with respect to the storage body 50.

Figure 18:
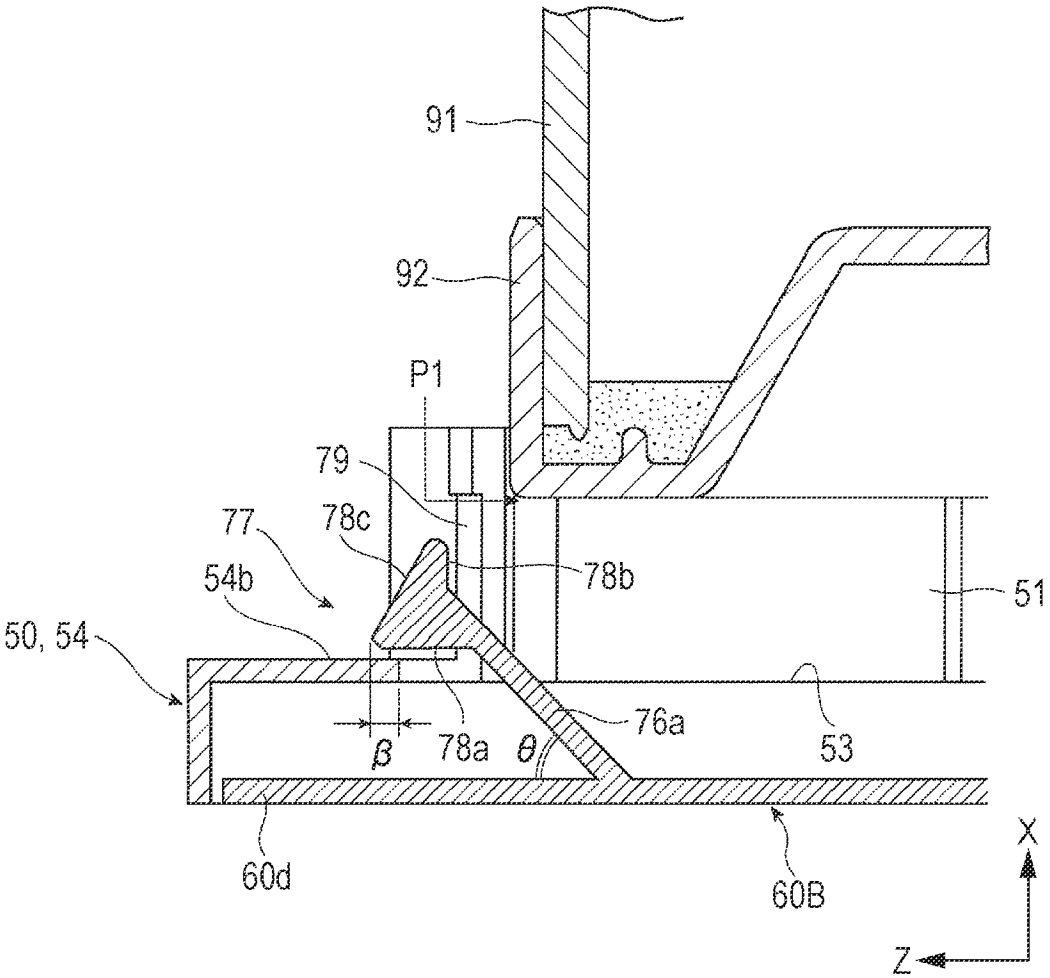
FIG. 18 is a partial enlarged sectional explanatory view of the structure of a fixing mechanism in the storage device shown in FIG. 15.

As shown from, for example, FIGS. 16 to 18, the catch portion 76 is formed at a location of the back surface of the opening/closing cover 60B that is situated at an inner side of the entrance 53 of the storage space 51. The catch portion 76 extends to an outer side of an opening frame of the entrance 53 so as to obliquely protrude and extend at a required angle θ (see FIG. 18) with respect to the back surface of the opening/closing cover 60. An end portion 78 of the catch portion 76 has an enlarged inverse triangular shape. The catch receiving portion 77 is formed at a portion of the entrance 53 of the storage space in the entrance frame 54 of the storage body 50. The catch receiving portion 77 exists at the outer side of the opening frame of the entrance 53 and at the back side of the entrance frame 54.

More specifically, as shown in, for example, FIG. 18, the catch portion 76 includes a plate-shaped body 76*a* and an end portion 78. The body 76*a* is formed so as to protrude obliquely at an angle of θ with respect to the back surface of the opening/closing cover 60. The end portion 78 having an enlarged inverse triangular shape is formed at a end (free end) of the body 76*a*. The end portion 78 includes a catch inclined surface portion 78*a*, a contact inclined surface portion 78*b*, and a guide surface 78*c*, which are described in detail below. That is, the catch inclined surface portion 78*a* is formed at a surface of an end-side portion of the body 76*a* that faces the back surface of the opening/closing cover 60 so that the catch inclined surface portion 78*a* protrudes obliquely. The catch inclined surface portion 78*a* is capable of being caught by a back side of the catch receiving portion 77. The contact inclined surface portion 78*b* is formed at a surface of the end-side portion of the body 76*a* that does not face the back surface of the opening/closing cover 60 so that the contact inclined surface portion 78*b* protrudes obliquely. The contact inclined surface portion 78*b* contacts a portion of the developer container 9 when it has moved towards the entrance 53 in the storage space. The guide surface 78*c* is formed in a plane including the body 76*a* and extending to an end portion of the catch inclined surface portion 78*a* and an end portion of the contact inclined surface portion 78*b*. The guide surface 78*c* passes a portion of the catch receiving portion 77 while contacting it when the guide surface 78*c* moves to the position of the back side of the catch receiving portion 77 and the position of the front side of the catch receiving portion 77.

The catch receiving portion 77 has an opening portion 79 that is formed in a portion of the entrance 53 of the storage space at the entrance frame 54 that faces the catch bending portion 76. The opening portion 79 is formed so as to have a size and shape that allows the end portion 78 of the catch bending portion 76 to easily pass a portion of a wall surface defining the storage space 51. The catch receiving portion 77 is formed as a back surface portion 54*b* of the entrance frame 54 that is formed continuously with the opening portion 79. As shown in FIG. 16, the catch receiving portion 77 has a gap W1 that, when the developer container 9 is at the storage stopping position P1 in the storage space 51 of the storage body 50, allows at least the end portion 78 of the catch receiving portion 77 to pass between a portion of the developer container 9 (a corner 92*a* of the cover portion) and an end portion of the back surface portion 54*b* of the catch receiving portion 77.

When the opening/closing cover 60 is rotated, using the fixing mechanism 70B, the end portion 78 of the catch portion 76 passes through the opening portion 79 (including the gap W1) of the catch receiving portion 77. Then, the end portion 78 moves to a position at the outer and back side of the entrance 53 (that is, the position of the back surface portion 54*b* of the entrance frame 54), and is caused to be in a caught state. Therefore, the opening/closing cover 60 is caused to be in a fixed state with respect to the storage body 50 (entrance frame 54) (see, for example, FIG. 17). When, using fixing mechanism 70B, the end portion 78 of the catch portion 76 is moved away from the position at the outer and back side of the entrance 53 (that is, the position of the back surface portion 54*b* of the entrance frame 54), and is set in an uncaught state, the opening/closing cover 60 is set in an unfixed state with respect to the storage body 50 (entrance frame 54) (see, for example, FIGS. 15 and 16).

As shown in FIG. 18, the catch portion 76 and the catch receiving portion 77 at the fixing mechanism 70B are set so as to be in a caught state as a result of causing the catch inclined surface portion 78*a* of the end portion 78 of the catch portion 76 to overlap and contact the back surface portion 54*b* of the catch receiving portion 77 by a required amount β (strictly speaking, the area). Further, in the fixing mechanism 70B, the guide surface 78*c* of the end portion 78 of the catch portion 76 and the end portion of the back surface portion 54*b* of the catch receiving portion 77 are in a positional relationship that allows them to contact each other and the guide surface 78*c* to pass the end portion of the back surface portion 54*b*, when the opening/closing cover 60 is rotated.

For example, the principal operations of the storage device 5B will hereunder be described.

First, when the entrance 53 of the entrance frame 54 of the storage body 50 is to be covered by closing the opening/closing cover 60B at the storage device 5B, the opening/closing cover 60 is rotated around the support shafts 61 as fulcra in the direction of arrow C3.

Figure 19:
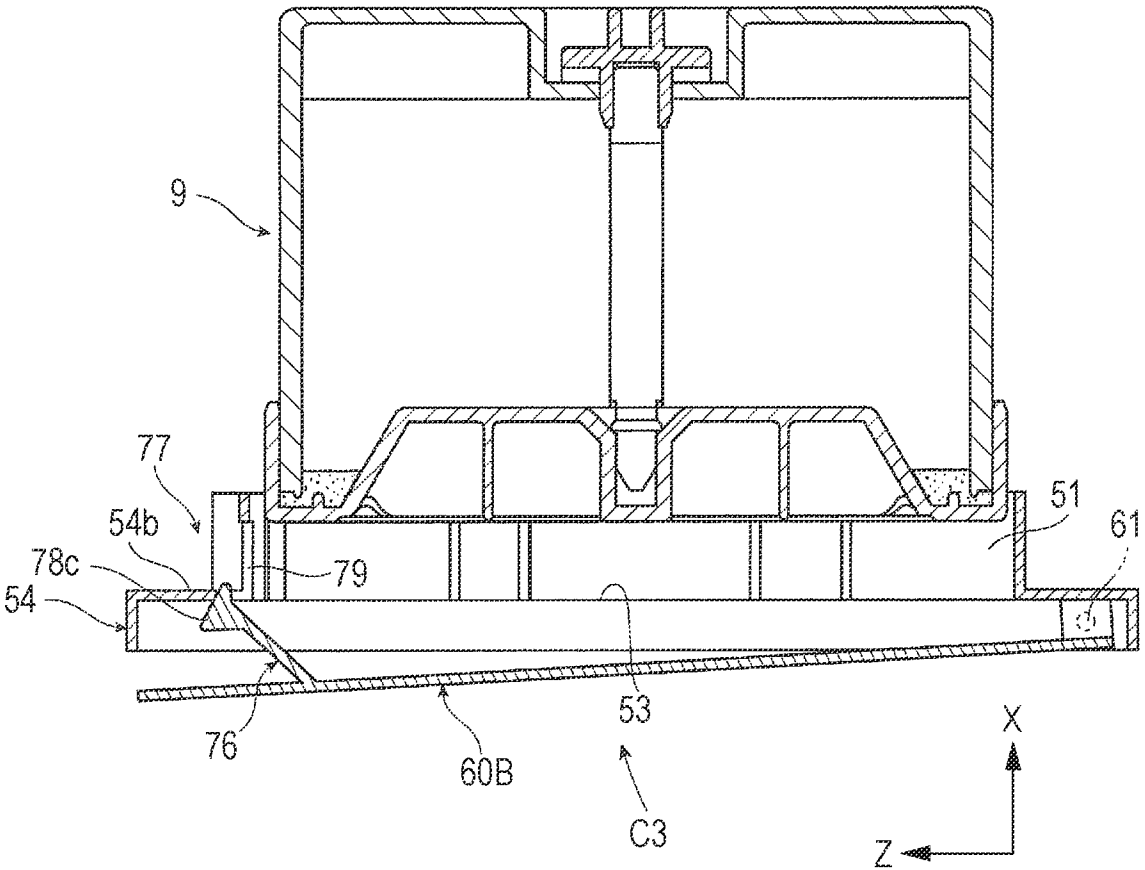
FIG. 19 is a partial sectional explanatory view showing a state during closing of the opening/closing cover of the storage device shown in FIG. 16.

Here, as shown in FIG. 19, the guide surface 78*c* of the end portion 78 of the catch portion 76 of the opening/closing cover 60B contacts the end portion of the back surface portion 54*b* of the catch receiving portion 77 at the entrance frame 54, and continues contacting it until it passes the end portion of the back surface portion 54*b*. At this time, when the entire end portion 78 is temporarily elastically bent (rotated) with respect to the body 76*a* in the direction in which it moves towards the back surface of the opening/closing cover 60B when the guide surface 78*c* passes the end portion of the back surface portion 54*b*, the catch portion 76 is capable of passing the end portion of the back surface portion 54*b*.

Next, when the guide surface 78*c* of the end portion 78 of the catch portion 76 passes the end portion of the back surface portion 54*b* of the catch receiving portion 77, the entire end portion 78 of the catch portion 76 passes through the opening portion 79 (including the gap W1) of the catch receiving portion 77. Then, the catch inclined surface portion 78*a* of the end portion 78 overlaps and contacts the back surface portion 54*b* of the catch receiving portion 77 by the required amount β. This causes the end portion 78 to be in the caught state (see FIGS. 17 and 18). As a result, the opening/closing cover 60B is closed, so that the entrance 53 is covered by the opening/closing cover 60.

When the entrance 53 of the entrance frame 54 of the storage body 50 is to be set in an uncovered state by opening the opening/closing cover 60B of the storage device 5B, the opening/closing cover 60B is rotated around the support shafts 61 as fulcra in the direction of arrow C4.

Figure 20:
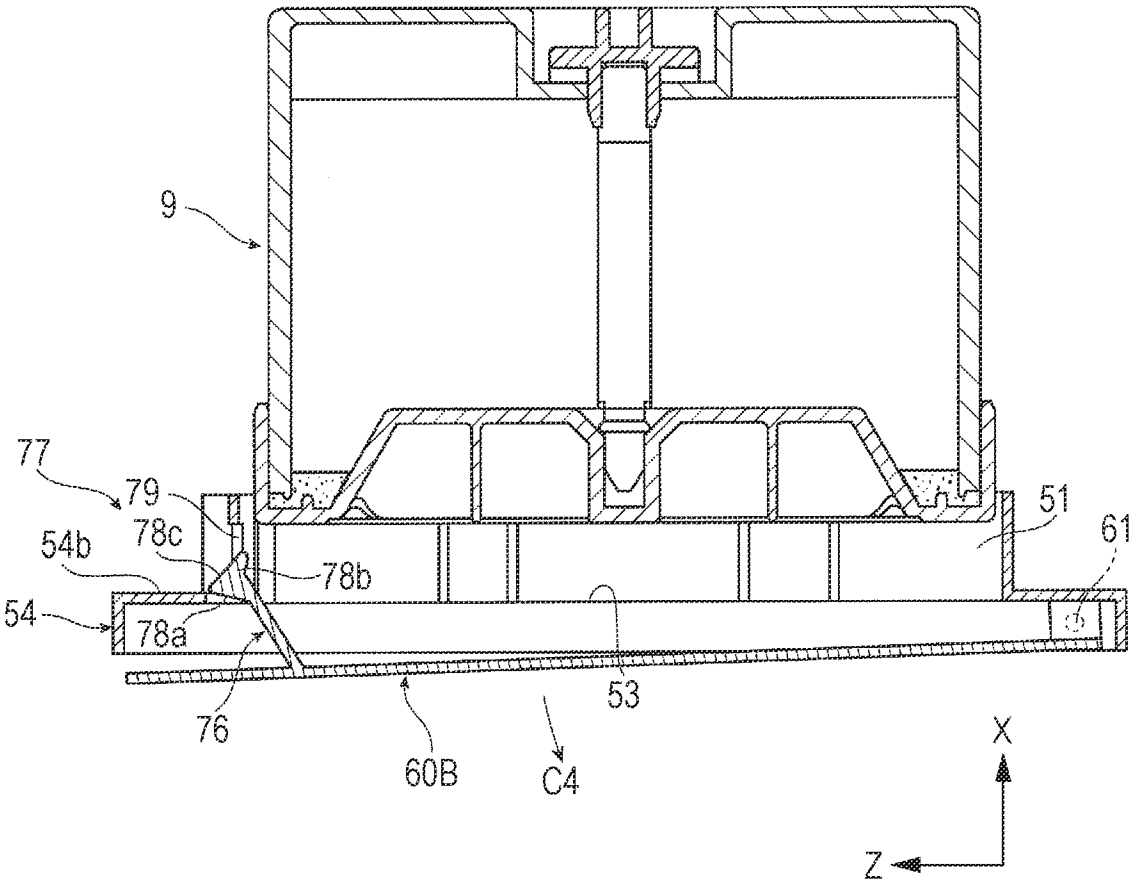
FIG. 20 is a partial sectional explanatory view showing a state during opening of the opening/closing cover in the storage device shown in FIG. 16.

Here, as shown in FIG. 20, while the catch inclined portion 78*a* of the end portion 78 is caught by the back surface portion 54*b* of the catch receiving portion 77 at the entrance frame 54, the catch portion 76 of the opening/closing cover 60B receives and is pulled by a force that is generated by the rotation of the opening/closing cover 60B around the support shafts 61 as fulcra in the direction of arrow C4. At this time, the end portion 78 of the catch portion 76 is such that the catch inclined surface portion 78*a* is elastically deformed so as to rotate towards the inner side of the entrance 53 with respect to the body 76*a* while the end portion of the back surface portion 54*b* of the catch receiving portion 77 serves as a fulcrum.

Next, when the catch inclined surface portion 78*a* of the end portion 78 of the catch portion 76 is to be set to the uncaught state with respect to the end portion of the back surface portion 54*b* of the catch receiving portion 77, the entire end portion 78 of the catch portion 76 moves through the opening portion 79 of the catch receiving portion 77, and is positioned at the front side of the catch receiving portion 77. This causes the state of the end portion 78 to change from the caught state to the uncaught state (see FIGS. 16 and 20). As a result, the opening/closing cover 60B opens, so that the entrance 53 is set in the uncovered state.

Figure 21:
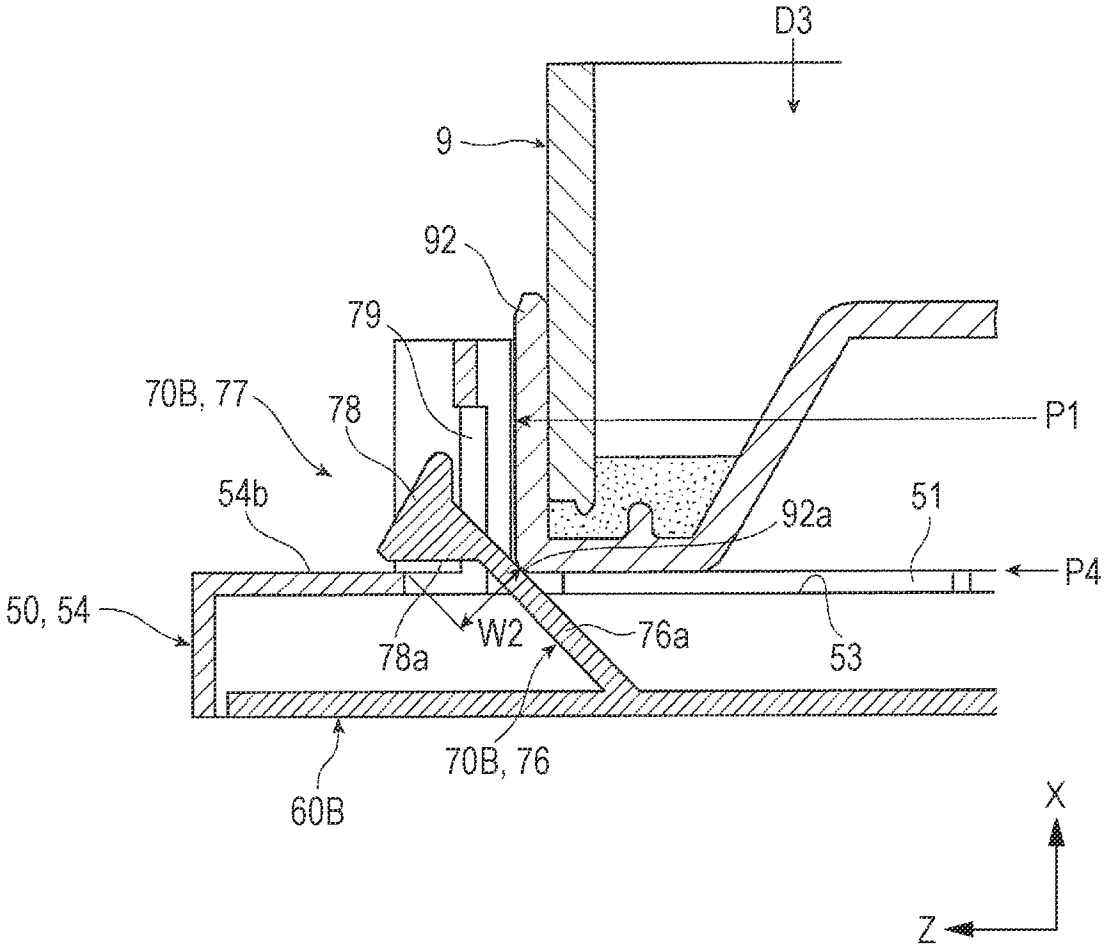
FIG. 21 is a partial enlarged sectional explanatory view of the state of the fixing mechanism at the storage device shown in FIG. 15 when the developer container is moved.

Next, in the storage device 5B, when the developer container 9 is set in the unfixed state (see FIG. 8A) with respect to the storage space 51 of the storage body 50, and the opening/closing cover 60B is closed and is kept in the fixed state using the fixing mechanism 70, as shown in, for example, FIG. 21, the developer container 9 may move from the proper storage stopping position P1 (the first position) towards the opening/closing cover 60 in the direction of arrow D3.

In this case, as shown in, for example, FIG. 21, when the developer container 9 moves from the proper storage stopping position P1 (see FIGS. 16 and 18) to a position P4 that is reached when the developer container 9 moves closer to the opening/closing cover 60, the corner 92*a* of the cover portion 92 of the developer container 9 contacts a portion of the body 76*a* of the catch portion 76 of the opening/closing cover 60 (that is, a surface of the opening/closing cover 60 that faces the developer container 9).

Here, the catch portion 76 exists as an obstacle that that prevents the movement of the developer container 9 towards the opening/closing cover 60. That is, since the catch portion 76 at this time is such that the catch inclined surface portion 78*a* of the end portion 78 is caught by the end portion of the back surface portion 54*b* of the catch receiving portion 77, the body 76*a* exists in a lying state so as to obliquely cross the movement direction of arrow D3 of the developer container 9 towards the entrance 53. The body 76*a* in this state exists as the obstacle. Here, when the developer container 9 moves towards the opening/closing cover 60, a gap W that is formed between a portion where the body 76*a* and the developer container 9 contact each other (that is, the corner 92*a* of the cover portion) and the end portion of the back surface portion 54*b* of the catch receiving portion 77 is such that the gap W2 (see FIG. 19) is narrower than the gap W1 that is formed when the developer container 9 is at the proper storage stopping position P1. Actually, as exemplified in FIG. 21, the gap W2 has a width that does not allow the end portion 78 of the catch portion 76 to pass.

As a result, as shown in FIG. 21, the movement of the developer container 9 towards the opening/closing cover 60 is stopped by the catch portion 76. The catch portion 76 at this time is such that the end portion 78 is not capable of passing through the gap W2 that is formed between the portion where the body 76*a* and the developer container 9 contact each other (that is, the corner 92*a* of the cover portion) and the end portion of the back surface portion 54*b* of the catch receiving portion 77. Therefore, the catch portion 76 remains caught by the end surface portion 54*b* of the catch receiving portion 77.

Therefore, in the storage device 5B, the movement of the catch portion 76 of the fixing mechanism 70B towards the entrance 53 of the developer container 9 is stopped while the catch portion 76 is caught by the end portion of the back surface portion 54*b* of the catch receiving portion 77. In other words, the fixing mechanism 70B in the storage device 5 causes the opening/closing cover 60 to be more firmly fixed than when the developer container 9 is stopped at the first position P1, when the developer container 9 blocks a portion of the gap W1 (formed between the catch receiving portion 77 and the end portion of the back surface portion 54*b*), that is, when the ordinary gap W1 is narrowed by moving the developer container 9 from the first position P1 to the second position P4. Therefore, the opening/closing cover 60B is maintained in a state in which it is kept in the fixed state using the fixing mechanism 70B and does not easily open. In addition, The ejection of the developer container 9 to the outside from the storage space 51 is suppressed because the opening/closing cover 60B does not open.

Incidentally, when subsequently opening the opening/closing cover 60B, the user only needs to rotate the opening/closing cover 60B in the direction of arrow C4.

Figure 22:
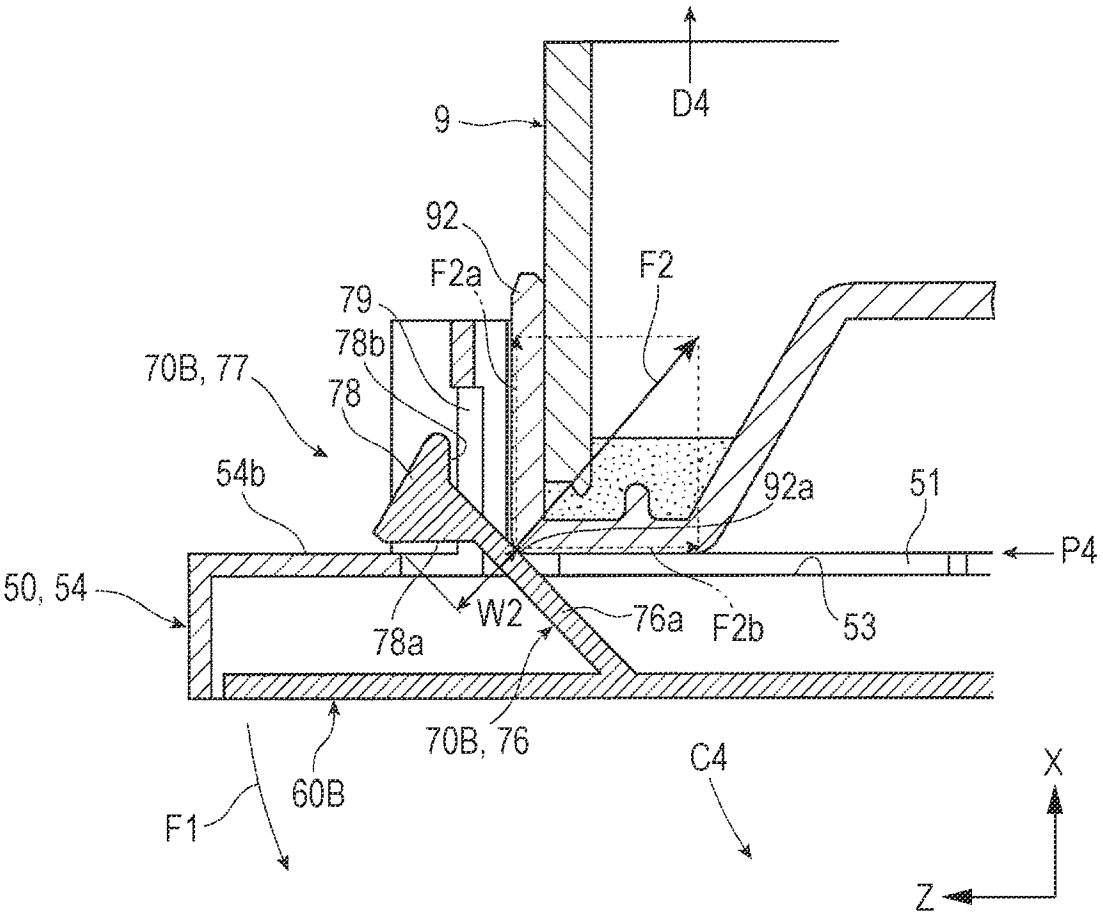
FIG. 22 is a partial enlarged sectional explanatory view showing an exemplary state of a force that is generated for pushing back the developer container when the opening/closing cover of the storage device shown in FIG. 21 is opened.

At this time, when the opening/closing cover 60B is rotated in the direction of arrow C4 in which the opening/closing cover 60B is opened, as shown in FIG. 22, a force F1 generated by the rotation of the opening/closing cover 60B in the direction of arrow C4 is transmitted to the catch portion 76 of the fixing mechanism 70B. By this, in the catch portion 76, with the catch inclined surface portion 78*a* being caught by and substantially fixed to the end portion of the back surface portion 54*b* of the catch receiving portion 77, the body 76*a* is subjected to the force F1 (that is generated by the rotation of the opening/closing cover 60B) and is linearly extended, so that the outer peripheral surface 92*a* of the cover portion 92 of the developer container 9 is subjected to a force F2. The force F2 acts obliquely backward so as to cross the direction of arrow D in which the developer container 9 is movable. Therefore, the force F2 is divided into a first component force F2*a* and a second component force F2*b*. The first component force F2*a* acts in a direction that is along the direction of arrow D in which the developer container 9 is movable. The second component force F2*b* acts in a direction that is orthogonal to the direction of arrow D in which the developer container 9 is movable. Of these component forces, the second component force F2*b* acts in the direction in which the developer container 9 is substantially guided in the storage space 51 and does not easily move, so that the second component force F2*b* is canceled. The remaining first component force F2*a* acts in a direction that is along the direction of arrow D in which the developer container 9 is movable. Therefore, the first component force F2*a* pushes back the developer container 9 in the direction of arrow D4 in which the developer container 9 moves towards the proper storage stopping position P1. The push-back force (first component force F2*a*) that is generated by the body 76*a* of the catch portion 76 becomes stronger as the body 76*a* is flexed by the movement of the developer container 9. As a result, the developer container 9 is subjected to the push-back force (first component force F2*a*) by the body 76*a* of the catch portion 76, so that the developer container 9 is pushed back slightly in the direction of arrow D4 so as to return to its proper storage stopping position P1.

Figure 23:
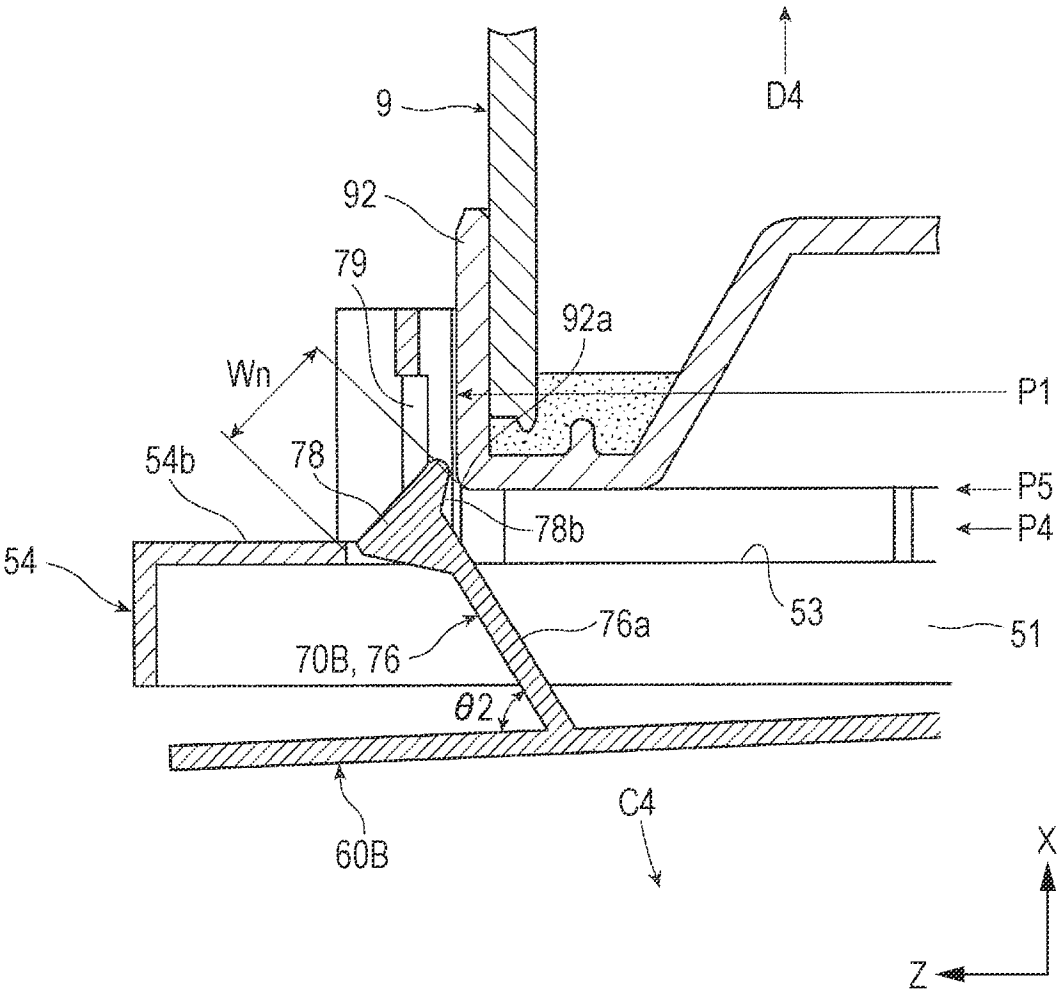
FIG. 23 is a partial enlarged sectional explanatory view showing a state during further opening of the opening/closing cover of the storage device shown in FIG. 22 (that is, a state when the fixing mechanism is to be set in an uncaught state)

Next, when the opening/closing cover 60B is further rotated in the direction of arrow C4 in which it is opened, as shown in FIG. 23, the end portion 78 of the catch portion 76 is elastically deformed so as to rotate in the direction in which the end portion 78 moves closer to the outer peripheral surface of the cover portion 92 of the developer container 9. Then, when the opening/closing cover 60B is further rotated in the direction in which it is opened from this state, while the contact inclined surface portion 78*b* of the end portion 78 of the catch portion 76 contacts the outer peripheral surface 92*a* of the cover portion 92 of the developer container 9, the contact inclined surface portion 78*b* moves to widen the narrow gap W2 that is formed between the end portion of the back surface portion 54*b* of the catch receiving portion 77 and the corner 92*a* of the cover portion 92 of the developer container 9. The movement of the contact inclined surface portion 78*b* newly generates push-back force in the direction of arrow D4 in which the developer container 9 moves towards the actual storage stopping position P1. Here, while the end portion 78 of the catch portion 76 is caught by the back surface portion 54*b* of the catch receiving portion 77, the catch portion 76 is subjected to a force that pulls it obliquely as a result of the rotation of the opening/closing cover 60B in the direction of arrow C4 in which the opening/closing cover 60B is opened. Therefore, the angle θ2 that is formed between the body 76*a* and the back surface of the opening/closing cover 60B is greater than the ordinary angle θ (θ2>θ).

As a result, the developer container 9 that is stopped at the position P4 where it contacts the opening/closing cover 60B by moving towards the opening/closing cover 60B receives a push-back force from the catch portion 76, so that the developer container 9 is displaced in the direction of arrow D4 in which it moves away from the opening/closing cover 60B. In this way, the developer container 9 is returned to a position P5 that is reached when the developer container 9 moves closer to the proper storage stopping position P1. Since the developer container 9 is pushed out, the gap W that is formed between the portion (the corner 92*a* of the cover portion) where the developer container 9 and the catch portion 76 contact each other and the end portion of the back surface portion 54*b* of the catch receiving portion 77 is widened to a gap Wn (W2<Wn≤W1) that is of a minimum size that allows the end portion 78 of the catch portion 76 to pass therethrough (see FIG. 23).

Figure 24:
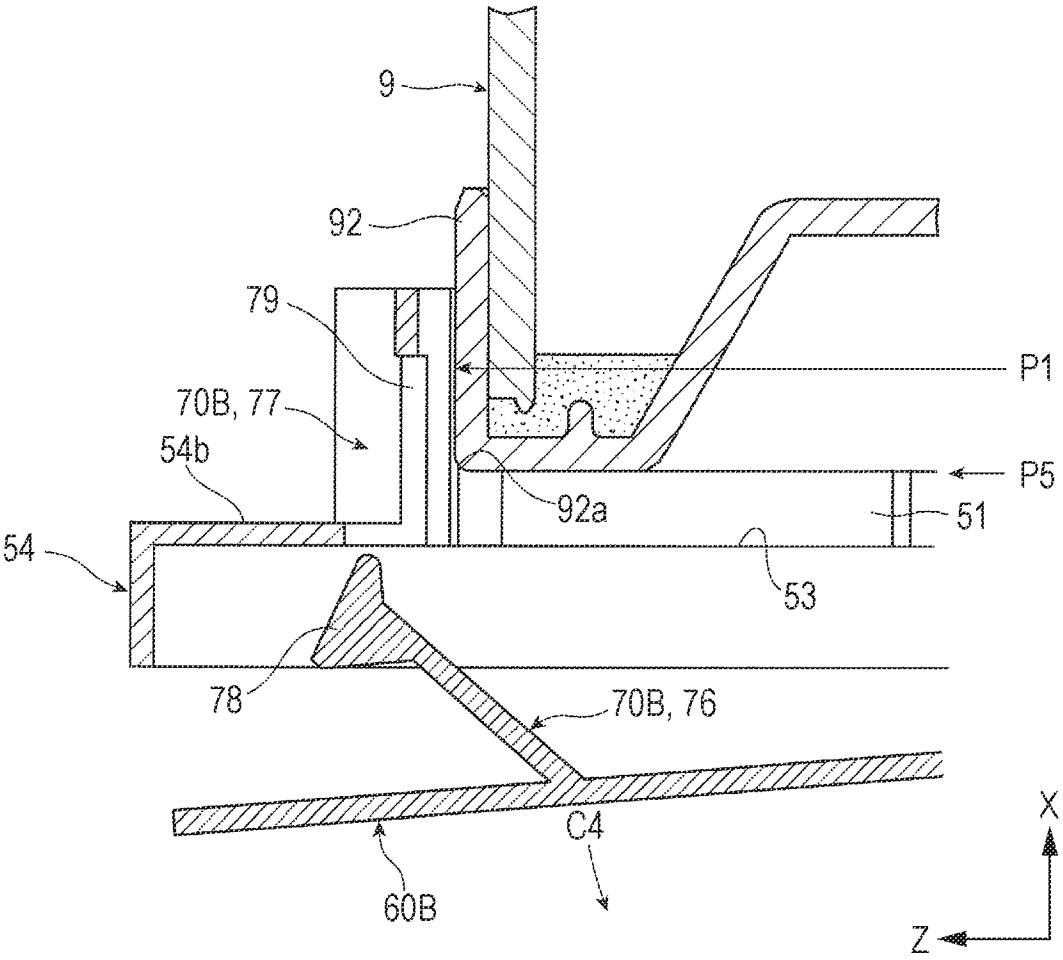
FIG. 24 is a partial enlarged sectional explanatory view showing a state when the fixing mechanism in the storage device shown in FIG. 23 is set in the uncaught state and the opening/closing cover is opened.

By the above, as shown in FIG. 24, the end portion 78 of the catch portion 76 is in a state in which it has passed through the gap Wn (formed between the end portion of the back surface portion 54*b* of the catch receiving portion 77 and the portion (the corner 92*a* of the cover portion) of the developer container 9 that contacts the catch receiving portion 77)) and is set in the uncaught state with respect to the back surface portion 54*b*. Therefore, thereafter, the opening/closing cover 60B is capable of being set in the open state by smoothly rotating the opening/closing cover 60B in the direction of arrow C4 in which the opening/closing cover 60B is opened. When the opening/closing cover 60B is opened, the developer container 9 is stopped at the position P5 to which it is slightly pushed back.

Other Exemplary Embodiments

In the storage device 5 according to the first exemplary embodiment, as exemplified in FIG. 25, when an inclined surface portion 92*c* that obliquely crosses the direction of arrow D3 in which the developer container 9 moves towards the entrance 53 of the storage space is formed on the cover portion 92 of the developer container 9, a displacement inducing portion 66 described below may be provided in place of the displacement inducing portion 65 that is provided on the back surface of the opening/closing cover 60.

Figure 25:
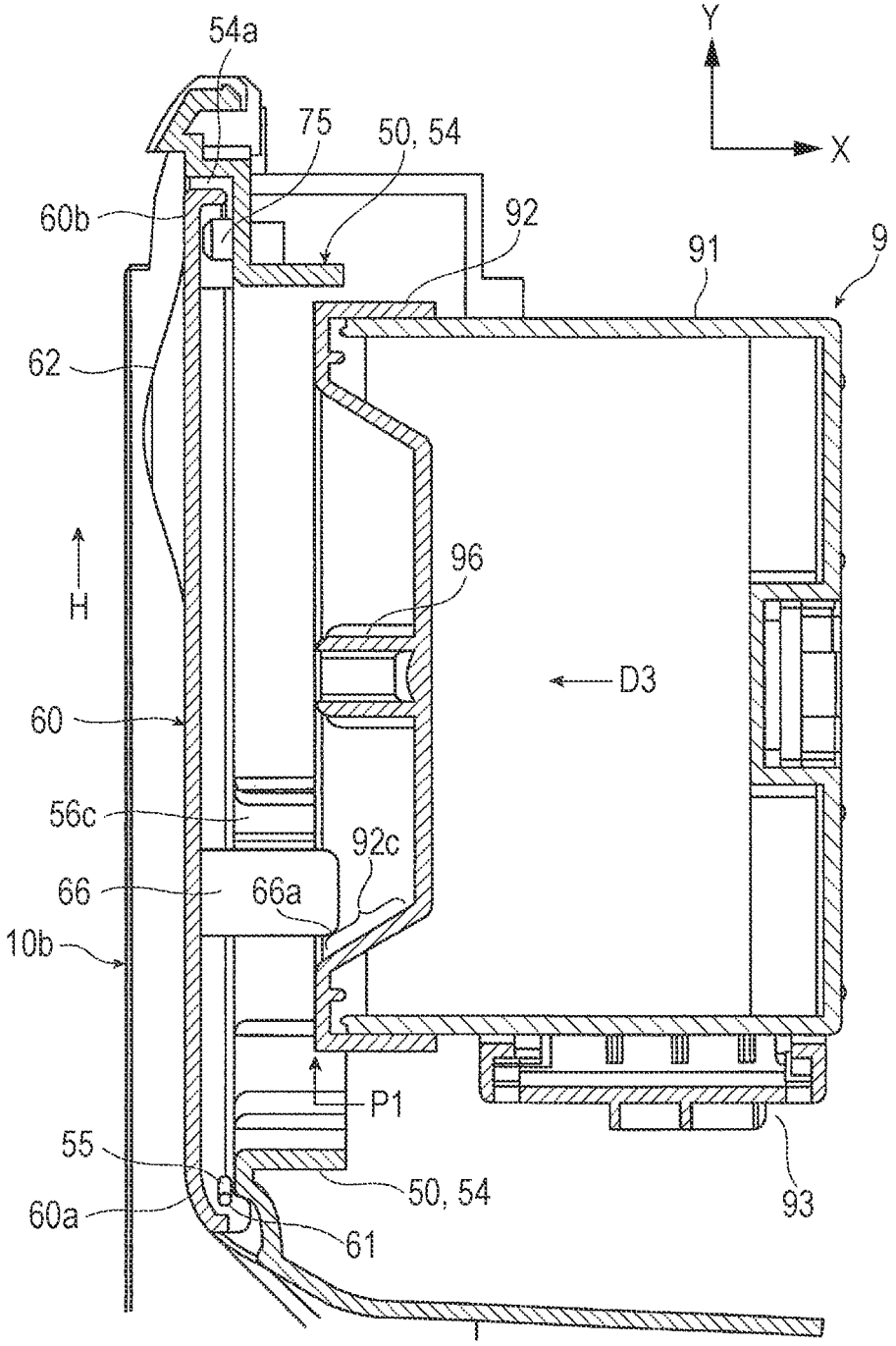
FIG. 25 is a sectional view of a principal portion of a storage device according to a third exemplary embodiment.

That is, the displacement inducing portion 66 that is illustrated in FIG. 25 contacts the inclined surface portion 92*c* of the cover portion 92 of the developer container 9, and, then, causes the opening/closing cover 60 to be displaced in the direction of arrow H in response to the movement of the developer container 9 towards the entrance 53, the direction of arrow H being a direction in which the catch amount α is increased. The inclined surface portion 92*c* of the cover portion 92 is an inclined portion whose position is higher towards the upstream side in the direction of arrow D3 in which the developer container 9 moves towards the entrance 53. The displacement inducing portion 66 is, for example, a rectangular plate member. A lower portion 66*a* of its end portion is caused to contact the inclined surface portion 92*c* of the cover portion 92 of the developer container 9.

Figure 26A:
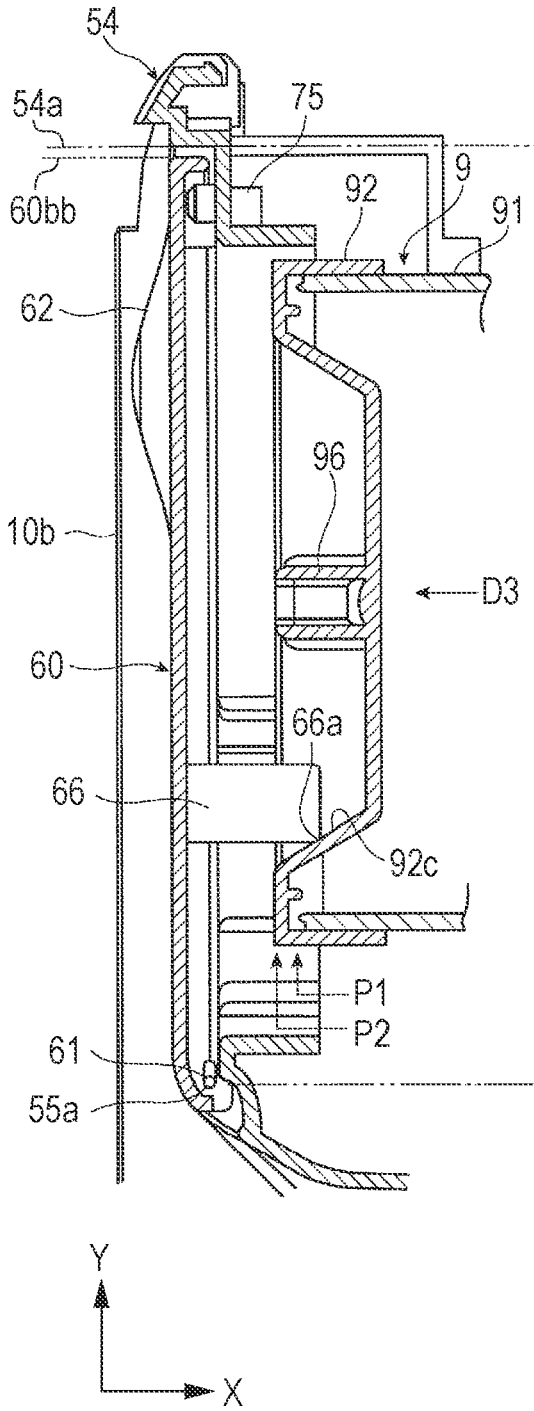
FIG. 26A is an explanatory view showing a state when the developer container at the storage device shown in FIG. 25 is moved slightly towards an entrance and contacts a displacement inducing section.
Figure 26B:
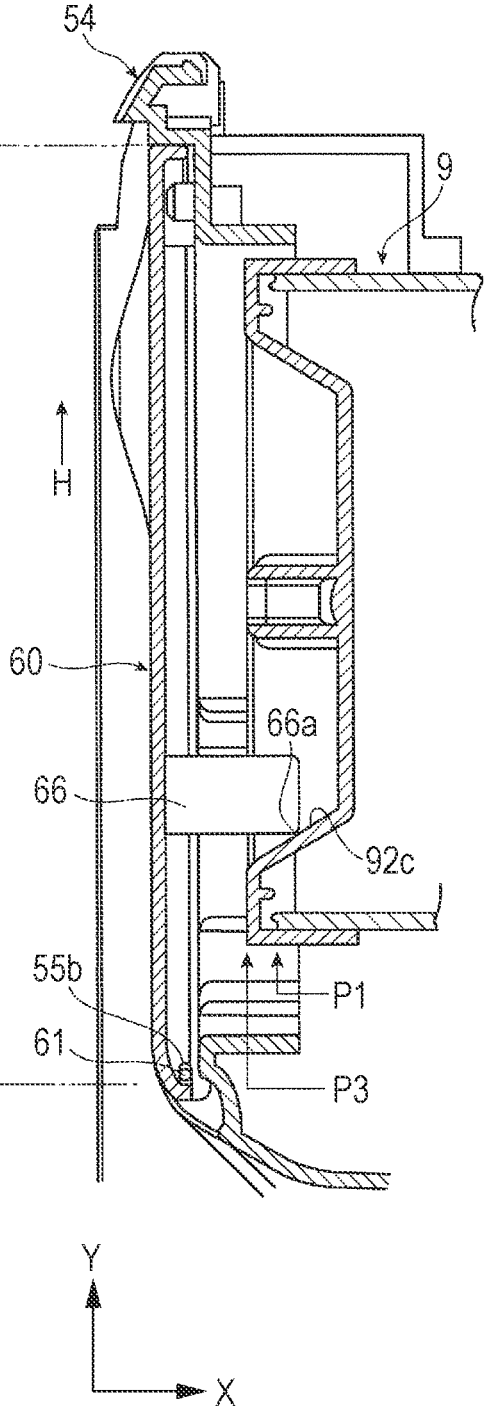
FIG. 26B is an explanatory view showing a state when the developer container at the storage device shown in FIG. 25 is further moved towards the entrance.

In the storage device 5 including the opening/closing cover 60 that is provided with the displacement inducing portion 66, if the developer container 9 is moved towards the entrance 53, and, as shown in FIG. 26A, the developer container 9 moves from the proper storage stopping position P1 to the position P2, where the developer container 9 contacts the opening/closing cover 60 by moving towards it, (a portion of) the inclined surface portion 92*c* of the cover portion 92 of the developer container 9 contacts the lower portion 66*a* of the end portion of the displacement inducing portion 66 of the opening/closing cover 60. Next, if the developer container 9 moves from the proper storage stopping position P1 to the position P3 where the developer container 9 contacts the opening/closing cover 60 by moving even closer to it, as shown in FIG. 26B, the inclined surface portion 92*c* of the cover portion 92 of the developer container 9 moves while pushing upward the lower portion 66*a* of the end of the displacement inducing portion 66 of the opening/closing cover 60.

Here, the displacement inducing portion 66 acts so that linear motion in the direction of arrow D3 in which the developer container 9 moves towards the entrance 63 is converted into linear motion in a direction that is substantially orthogonal to the linear motion in the direction of arrow D3 and that corresponds to a direction in which the opening/closing cover 60 is displaced in the upward direction of arrow H. Therefore, as shown in, for example, FIG. 26B, the displacement inducing portion 66 is displaced in the direction of arrow H in response to the movement of the developer container 9 towards the entrance 63, the direction of arrow H being a direction in which the catch amount α is increased. As a result, as shown in, for example, FIG. 11B, the size (area) of the portion of the catch surface portion 73 of the bending portion 71 of the fixing mechanism 70 at the opening/closing cover 60 that overlaps and contacts the catch receiving surface portion 74 of the catch receiving portion 72 of the fixing mechanism 70 at the entrance frame 54 is increased, so that the catch amount α of the catch bending portion 71 is increased. Consequently, when the developer container 9 moves from the first position P1 to the second position P2 (P3), the fixing mechanism 70 causes the opening/closing cover 60 to be more firmly fixed than when the developer container 9 is stopped at the first position P1.

Incidentally, when subsequently opening the opening/closing cover 60, the user only needs to return the catch amount α of the catch bending portion 71 to the ordinary catch amount by forcefully displacing the opening/closing cover 60 in a direction opposite to the direction of arrow H in which the catch amount α increases, or tilting the opening/closing cover 60 so as to be displaced in a direction in which the developer container 9 moves away from the opening/closing cover 60. By this, the opening/closing cover 60 is relatively weakly fixed by the fixing mechanism 70, so that the opening/closing cover 60 is capable of being easily opened and closed.

In the storage device 5 according to the first exemplary embodiment, it is possible to use the displacement inducing portion 65 including the inclined portion 65*a* as the displacement inducing portion 65 provided at the opening/closing cover 60, and the inclined surface portion 92*c* described above as a portion of the cover portion 92 of the developer container 9 that is capable of contacting the inclined portion 65*a* of the displacement inducing portion 65. In this case, when the developer container 9 has moved to the position P2 (P3), where the developer container 9 contacts the opening/closing cover 60 by moving closer to it, the inclined surface portion 92*c* of the cover portion 92 of the developer container 9 and the inclined portion 65*a* of the displacement inducing portion 65 of the opening/closing cover 60 contact each other. In addition, the displacement inducing portion 65 displaces the opening/closing cover 60 in the direction of arrow H (corresponding to a direction in which the catch amount α is increased) in response to the movement of the developer container 9 to the position P2 (P3), where the developer container 9 contacts the opening/closing cover 60 by moving closer to it. Further, the displacement inducing portion 65 may be formed so that the inclined portion 65*a* exists at the inner side surface of the opening/closing cover 60.

In the second exemplary embodiment, it is possible to change the position where the catch portion 76 is provided in the fixing mechanism 70B, and the number of catch portions 76. The position where the catch portion 76 is provided is not particularly limited as long as the catch portion 76 is provided at a portion of the opening 53. For example, from the viewpoint of stabilizing the fixed state using the fixing mechanism 70B by closing the opening/closing cover 60B, it is desirable to provide the catch portion 76 at a portion (periphery) of the end portion of the opening/closing cover 60B that is opposite to the end portion 60*c* where the support shafts 61 are provided. One or more catch portions 76 may be provided. The position where the catch receiving portion 77 of the fixing mechanism 70B is provided and the number of catch receiving portions 77 are set in accordance with the position where the catch portion 76 is provided and the number of catch portions 76.

In the second exemplary embodiment, the target portions where the catch portion 76 and the catch receiving portion 77 of the fixing mechanism 70B are provided may be changed. For example, the catch portion 76 may be provided in a portion of the storage space 51 of the storage body 50, and the catch receiving portion 77 may be provided on the back surface of the opening/closing cover 60B.

Although, in the first and second exemplary embodiments, the storage device 5(5B) is exemplified as a device that stores the developer container 9, the storage device 5 may be a storage device that stores a structural member other than the developer container 9. Examples of structural members that are stored other than the developer container 9 are units including an image carrying member, storage sections of recording media (such as recording paper), and drawers in which structural units are placed. As the opening/closing cover 60(60B) of the storage device 5(5B), a cover having a structure that allows it to be mounted by fitting the support shafts, which are provided at the storage body 50, may be used. The storage device may be, in addition to a storage device that is included in the image forming apparatus, for example, a drawer of a desk that is transported while items are stored therein, or various devices that store replacing items. Further, the image forming apparatus 1 that uses the storage device 5(5B) may be one having another form or structure as long as it forms an image using developer.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A storage device comprising:

a housing including a storage space that stores a structural member;

a cover member that is mounted on the housing, the cover member being configured to cause an entrance of the storage space of the housing to be in either a covered state or an uncovered state; and a fixing mechanism configured to fix the cover member to the housing that is in the covered state, wherein the structural member is configured to be stored at a first position in a fixed state and at a second position in an unfixed state in the storage space when the entrance of the storage space is caused to be in the covered state by the cover member, wherein the second position is closer to the cover member than the first position is, and wherein the fixing mechanism is configured to cause the cover member to be more firmly fixed when the structural member has moved from the first position to the second position than when the structural member is stopped at the first position.

2. The storage device according to claim 1, wherein the fixing mechanism is configured to cause the cover member to be more firmly fixed when the structural member has moved from the first position to the second position as a result of contacting the structural member with a portion of the housing or the cover member.

3. The storage device according to claim 1, wherein the cover member is movable in a first direction while the entrance of the storage space is in the covered state, and wherein the fixing mechanism is configured to cause the cover member to be more firmly fixed as a result of converting momentum that is provided when the structural member moves from the first position to the second position into momentum that is required for moving the cover member in the first direction.

4. The storage device according to claim 3, wherein the fixing mechanism includes a bending portion and a holding portion, wherein the bending portion extends from the cover member, wherein the holding portion is connected to the housing and is provided so as to oppose the bending portion, wherein the holding portion contacts the bending portion to hold the bending portion, and wherein the storage device is configured such that, when the cover member has moved in the first direction, displacement occurs in a direction in which an area of a region where the holding portion and the bending portion oppose each other is increased.

5. The storage device according to claim 4, wherein a side of the cover member that opposes the structural member or a side of the structural member that opposes the cover member is provided with an inclined surface that contacts the structural member or the cover member when the structural member has moved from the first position to the second position, the inclined surface inclining in a direction that crosses a movement direction of the structural member and the first direction of the cover member, and wherein the storage device is configured such that, when the inclined surface converts a force that is provided when the structural member and the cover member contact each other, the cover member is moved in the first direction that differs from the movement direction of the structural member, so that strength of the fixing mechanism is increased.

6. The storage device according to claim 1, wherein the fixing mechanism includes a bending portion and a holding portion, wherein the bending portion extends from the cover member, wherein the holding portion is connected to the housing and is provided so as to oppose the bending portion, wherein the holding portion contacts the bending portion to hold the bending portion, wherein the storage device is configured such that, when the structural member is at the first position, the bending portion passes through a space that is formed between the housing and the structural member, so that the cover member opens with respect to the housing, and wherein the storage device is configured such that, when the structural member moves from the first position to the second position, the structural member blocks a portion of the space, so that the fixing mechanism causes the cover member to be more firmly fixed to the housing.

7. An image forming apparatus comprising:

the storage device according to claim 1.

8. The image forming apparatus according to claim 7, wherein the structural member comprises a developer container that contains developer.

* * * * *